US009715849B2

(12) United States Patent
Fujii

(10) Patent No.: US 9,715,849 B2
(45) Date of Patent: Jul. 25, 2017

(54) DATA COMPENSATION CIRCUIT AND ORGANIC LIGHT-EMITTING DIODE DISPLAY HAVING THE SAME

(71) Applicant: Samsung Display Co., Ltd., Yongin, Gyeonggi-Do (KR)

(72) Inventor: Mitsuru Fujii, Cheonan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 10 days.

(21) Appl. No.: 14/626,131

(22) Filed: Feb. 19, 2015

(65) Prior Publication Data

US 2016/0117982 A1 Apr. 28, 2016

(30) Foreign Application Priority Data

Oct. 22, 2014 (KR) ..... 10-2014-0143171

(51) Int. Cl.
*G09G 3/3225* (2016.01)

(52) U.S. Cl.
CPC ..... *G09G 3/3225* (2013.01); *G09G 2320/029* (2013.01); *G09G 2320/0223* (2013.01); *G09G 2320/0233* (2013.01); *G09G 2320/0285* (2013.01); *G09G 2320/043* (2013.01); *G09G 2360/16* (2013.01)

(58) Field of Classification Search
CPC ..... G09G 2320/0223; G09G 3/3233; G09G 2320/0285; G09G 2320/0626; G09G 2360/16; G09G 2320/043; G09G 2320/02
USPC ..... 345/76, 211, 212
See application file for complete search history.

(56) References Cited

U.S. PATENT DOCUMENTS

2003/0030654 A1* 2/2003 Sagano ..... G09G 3/22 345/660
2010/0149162 A1* 6/2010 Park ..... G09G 3/2007 345/212
2014/0062989 A1* 3/2014 Ebisuno ..... G09G 3/3241 345/212

FOREIGN PATENT DOCUMENTS

KR 10-2010-0068075 A 6/2010
KR 10-2011-0123952 A 11/2011
KR 10-2012-0074946 A 7/2012
KR 10-2012-0111675 A 10/2012

* cited by examiner

*Primary Examiner* — Koosha Sharifi-Tafreshi
(74) *Attorney, Agent, or Firm* — Knobbe Martens Olson & Bear LLP

(57) ABSTRACT

A data compensation circuit and OLED display including the same are disclosed. In one aspect, the circuit compensates a voltage drop of a power voltage applied to a display panel of the display. The circuit includes an average current calculator configured to calculate an average current value of each of M×N pixel blocks. The circuit also includes a voltage drop calculator configured to calculate one or more pixel block voltage drops of the power voltage of each of the selected target pixel blocks based at least in part on an X-axis voltage drop and a Y-axis voltage drop of each of target pixel block. The circuit further includes an interpolator configured to interpolate the pixel block voltage drops of adjacent target pixel blocks so as to calculate a pixel voltage drop of a target pixel selected among one of the target pixel blocks.

25 Claims, 12 Drawing Sheets

DATA COMPENSATION CIRCUIT AND ORGANIC LIGHT-EMITTING DIODE DISPLAY HAVING THE SAME

INCORPORATION BY REFERENCE TO ANY PRIORITY APPLICATIONS

This application claims priority from and the benefit of Korean Patent Application No. 10-2014-0143171, filed on Oct. 22, 2014 in the Korean Intellectual Property Office (KIPO), the disclosure of which is hereby incorporated by reference herein in its entirety.

BACKGROUND

Field

The described technology generally relates to data compensation technology and organic light-emitting diode displays having the same.

Description of the Related Technology

An organic light-emitting diode (OLED) display generates images using pixels having OLEDs. Each OLED generates light based on a recombination of electrons and holes in an active layer. OLED technology has favorable characteristics including fast response speeds and low power consumption.

These displays generate an image by causing a current to flow to a matrix of OLEDs, and emit light. A driving thin film transistor (TFT) each pixel circuit causes a current to flow in accordance with the grayscale level of image data.

SUMMARY OF CERTAIN INVENTIVE ASPECTS

One inventive aspect is a data compensating apparatus to two-dimensionally compensate voltage drops of signal lines.

Another aspect is an OLED display including the data compensating apparatus.

Another aspect is a data compensating apparatus that can comprise an average current calculator configured to calculate an average current of each of M×N pixel blocks, where M and N are positive integers, based on input image data, the each of the M×N pixel blocks including a plurality of pixels, a voltage drop calculator configured to calculate pixel block voltage drops of the power voltage of each of target pixel blocks according to an X-axis voltage drop and a Y-axis voltage drop of the each of the target pixel blocks based on a product of an Y-axis voltage drop weighted value and an X-axis voltage drop distribution coefficient, the target pixel blocks being selected among the pixel blocks, an interpolator configured to calculate a pixel voltage drop of a target pixel by interpolating the pixel block voltage drops of adjacent ones of the target pixel blocks, and a compensated data generator configured to generate a compensated data voltage by compensating a data voltage of the input image data based on the pixel voltage drop.

In example embodiments, the product of the Y-axis voltage drop weighted value and the X-axis voltage drop distribution coefficient corresponds to an amount of a current flowing into the each of the target pixel blocks when a unit current is applied to a reference pixel block that is selected among the pixel blocks.

In example embodiments, the Y-axis voltage drop weighted value is a weighted value of the Y-axis voltage drop of the each of the target pixel blocks when a unit current is applied to a reference pixel block that is selected among the pixel blocks.

In example embodiments, the voltage drop calculator sets the Y-axis voltage drop weighted value to have a Y-coordinate value of the reference pixel block when the Y-coordinate value of the reference pixel block is less than a Y-coordinate value of the each of the target pixel blocks. The voltage drop calculator can set the Y-axis voltage drop weighted value to have the Y-coordinate value of the each of the target pixel blocks when the Y-coordinate value of the reference pixel block is greater than or equal to the Y-coordinate value of the each of the target pixel blocks.

In example embodiments, the X-axis voltage drop distribution coefficient is represented as Smn(x, y), where x is a positive integer less than or equal to M and y is a positive integer less than or equal to N. The Smn(x, y) can be a normalized value of the X-axis voltage drop of the each of the target pixel blocks located at a coordinate (x, y) when the unit current is applied to the reference pixel block located at a coordinate (m, n), where m is a positive integer less than or equal to M and n is a positive integer less than or equal to N.

In example embodiments, a first X-axis voltage drop distribution coefficient is substantially equal to a second X-axis voltage drop distribution coefficient. The first X-axis voltage drop distribution coefficient can be the X-axis voltage drop distribution coefficient of the each of the target pixel blocks located at a second X-coordinate when the unit current is applied to the reference pixel block located at a first X-coordinate. The second X-axis voltage drop distribution coefficient can be the X-axis voltage drop distribution coefficient of the each of the target pixel blocks located at the first X-coordinate when the unit current is applied to the reference pixel block located at the second X-coordinate.

In example embodiments, a first X-axis voltage drop distribution coefficient is substantially equal to a second X-axis voltage drop distribution coefficient. The first X-axis voltage drop distribution coefficient can be the X-axis voltage drop distribution coefficient of the each of the target pixel blocks located at a second Y-coordinate when the unit current is applied to the reference pixel block located at a first Y-coordinate. The second X-axis voltage drop distribution coefficient can be the X-axis voltage drop distribution coefficient of the each of the target pixel blocks located at the first Y-coordinate when the unit current is applied to the reference pixel block located at the second Y-coordinate.

In example embodiments, the voltage drop calculator calculates the pixel block voltage drop of the each of the target pixel blocks using [Equation] below, $$Vdrop(x, y) = Rs \times \sum_{m=1}^{M} \sum_{n=1}^{N} Imn \times Smn(x, y) \times Yn,$$

(where Rs denotes a resistance coefficient, Imn denotes the average current of a reference pixel block corresponding to a coordinate (m, n) selected among the pixel blocks, Smn(x, y) denotes the X-axis voltage drop distribution coefficient corresponding to a coordinate (x, y) selected among the target pixel blocks when a unit current flows through the reference pixel block, Yn denotes the Y-axis voltage drop weighted value, M denotes total number of the pixel blocks in the X-axis direction, and N denotes total number of the pixel blocks in the Y-axis direction).

In example embodiments, the voltage drop calculator includes a first multiplier configured to output first results by multiplying the average current of the reference pixel block corresponding to the coordinate (m, n) by the X-axis voltage drop distribution coefficient corresponding to the coordinate (x, y), a second multiplier configured to output second results by multiplying each of the first results corresponding to the coordinate (m, n) by the Y-axis voltage drop weighted value corresponding to the coordinate (m, n), and an adder configured to output the pixel block voltage drop of the each of the target pixel blocks by summing up the second results.

In example embodiments, the pixel blocks include center pixels each located at a center of the each of the pixel blocks. The interpolator can set the pixel voltage drop of each of the center pixels to be the pixel block voltage drop of the each of the target pixel blocks, and estimate the pixel voltage drop of the target pixel by performing a bilinear interpolation on the pixel voltage drops of adjacent four center pixels that are adjacent to the target pixel.

In example embodiments, the compensated data generator includes a maximum value detector configured to detect a maximum voltage drop among the pixel block voltage drops of the target pixel blocks in one frame, a comparator configured to calculate a delta value that is a difference between the maximum voltage drop and the pixel voltage drop of the target pixel, and a subtractor configured to generate the compensated data voltage by subtracting the delta value from the data voltage of the input image data.

In example embodiments, the maximum value detector fixes the maximum voltage drop to be a predetermined value.

In example embodiments, the data compensating apparatus further comprises a common voltage drop calculator configured to calculate a total current that is a sum of the average currents of the pixel blocks and to calculate a common voltage drop of the display panel based on the total current.

In example embodiments, the compensated data generator generates the compensated data voltage based on respective values generated by adding the common voltage drop to the pixel block voltage drops of the target pixel blocks.

In example embodiments, the common voltage drop calculator deactivates the compensated data generator when the total current is less than a predetermined reference value.

Another aspect is an OLED display that can comprise a display panel including M×N pixel blocks each having a plurality of pixels, where M and N are positive integers, a data compensator configured to generate a compensated data voltage based on pixel block voltage drops of each of the pixel blocks, the pixel block voltage drops being calculated according to an X-axis voltage drop and a Y-axis voltage drop of the each of the target pixel blocks, a scan driver configured to provide a scan signal to the display panel, a data driver configured to provide the compensated data voltage to the display panel, a timing controller configured to control the scan driver and the data driver, and a power supply configured to provide a first power voltage and a second power voltage to the display panel.

In example embodiments, the data compensator includes an average current calculator configured to calculate the average current of the each of the pixel blocks based on input image data, a voltage drop calculator configured to calculate the pixel block voltage drops of the first power voltage of the each of the target pixel blocks based on a product of an Y-axis voltage drop weight and a X-axis voltage drop distribution coefficient, an interpolator configured to a pixel voltage drop of a target pixel by interpolating the pixel block voltage drops of adjacent ones of the target pixel blocks, and a compensated data generator configured to generate the compensated data voltage by compensating a data voltage of the input image data based on the pixel voltage drop.

In example embodiments, the product of the Y-axis voltage drop weighted value and the X-axis voltage drop distribution coefficient corresponds to an amount of a current flowing into the each of the target pixel blocks when a unit current is applied to a reference pixel block that is selected among the pixel blocks.

In example embodiments, the X-axis voltage drop distribution coefficient is a normalized value of the X-axis voltage drop of the each of the target pixel blocks located at a coordinate (x, y), where x is a positive integer less than or equal to M and y is a positive integer less than or equal to N, when the unit current is applied to the reference pixel block located at a coordinate (m, n), where m is a positive integer less than or equal to M and n is a positive integer less than or equal to N.

In example embodiments, the voltage drop calculator calculates the pixel block voltage drop of the each of the target pixel blocks using [Equation] below, $$Vdrop(x, y) = Rs \times \sum_{m=1}^{M} \sum_{n=1}^{N} Imn \times Smn(x, y) \times Yn,$$

(where Rs denotes a resistance coefficient, Imn denotes the average current of the reference pixel block corresponding to the coordinate (m, n), Smn(x, y) denotes the X-axis voltage drop distribution coefficient corresponding to the coordinate (x, y) selected among the target pixel blocks when the unit current flows through the reference pixel block, Yn denotes the Y-axis voltage drop weight, M denotes total number of the pixel blocks in the X-axis direction, and N denotes total number of the pixel blocks in the Y-axis direction).

Another aspect is data compensation circuit for compensating a voltage drop of a power voltage applied to a display panel of an organic light-emitting diode (OLED) display, the circuit comprising an average current calculator configured to calculate an average current value of each of M×N pixel blocks, where M and N are positive integers, based at least in part on input image data, wherein each of the M×N pixel blocks includes a plurality of pixels, and wherein a plurality of target pixel blocks are selected among the pixel blocks. The circuit also comprises a voltage drop calculator configured to calculate one or more pixel block voltage drops of the power voltage of each of the selected target pixel blocks based at least in part on an X-axis voltage drop and a Y-axis voltage drop of each of the target pixel blocks, wherein voltage drop calculator is further configured to calculate the X-axis and Y-axis voltage drops based at least in part on the product of a Y-axis voltage drop weighted value and an X-axis voltage drop distribution coefficient. The circuit further comprises an interpolator configured to interpolate the pixel block voltage drops of adjacent target pixel blocks so as to calculate a pixel voltage drop of a target pixel selected among one of the target pixel blocks. The circuit additionally comprises a compensated data generator configured to compensate a data voltage of the input image data based at least in part on the pixel voltage drop so as generate a compensated data voltage.

In the above circuit, the product corresponds to an amount of current flowing into each of the target pixel blocks when a unit current is applied to a selected reference pixel block of the pixel blocks.

In the above circuit, the Y-axis voltage drop weighted value includes a weighted value of the Y-axis voltage drop of each of the target pixel blocks when a unit current is applied to a selected reference pixel block of the pixel blocks.

In the above circuit, the voltage drop calculator is further configured to set the Y-axis voltage drop weighted value to have a Y-coordinate value of the reference pixel block when the Y-coordinate value of the reference pixel block is less than a Y-coordinate value of each of the target pixel blocks, wherein the voltage drop calculator is further configured to set the Y-axis voltage drop weighted value to have the Y-coordinate value of each of the target pixel blocks when the Y-coordinate value of the reference pixel block is greater than or equal to the Y-coordinate value of each of the target pixel blocks.

In the above circuit, the X-axis voltage drop distribution coefficient is represented as Smn(x, y), wherein the Smn(x, y) is a normalized value of the X-axis voltage drop of each of the target pixel blocks located at a coordinate (x, y) when the unit current is applied to the reference pixel block located at a coordinate (m, n), where x and m are positive integers less than or equal to M, and where y and n are a positive integer less than or equal to N.

In the above circuit, a first X-axis voltage drop distribution coefficient is substantially equal to a second X-axis voltage drop distribution coefficient, wherein the first X-axis voltage drop distribution coefficient includes the X-axis voltage drop distribution coefficient of each of the target pixel blocks located at a second X-coordinate when the unit current is applied to the reference pixel block located at a first X-coordinate, and wherein the second X-axis voltage drop distribution coefficient includes the X-axis voltage drop distribution coefficient of each of the target pixel blocks located at the first X-coordinate when the unit current is applied to the reference pixel block located at the second X-coordinate.

In the above circuit, a first X-axis voltage drop distribution coefficient is substantially equal to a second X-axis voltage drop distribution coefficient, wherein the first X-axis voltage drop distribution coefficient is the X-axis voltage drop distribution coefficient of each of the target pixel blocks located at a second Y-coordinate when the unit current is applied to the reference pixel block located at a first Y-coordinate, and wherein the second X-axis voltage drop distribution coefficient is the X-axis voltage drop distribution coefficient of each of the target pixel blocks located at the first Y-coordinate when the unit current is applied to the reference pixel block located at the second Y-coordinate.

In the above circuit, the voltage drop calculator is further configured to calculate the pixel block voltage drop of each of the target pixel blocks based on the following Equation:

$$Vdrop(x, y) = Rs \times \sum_{m=1}^{M} \sum_{n=1}^{N} Imn \times Smn(x, y) \times Yn,$$

where Rs denotes a resistance coefficient, Imn denotes the average current value of a reference pixel block corresponding to a coordinate (m, n) selected among the pixel blocks, Smn(x, y) denotes the X-axis voltage drop distribution coefficient corresponding to a coordinate (x, y) selected among the target pixel blocks when a unit current flows through the reference pixel block, Yn denotes the Y-axis voltage drop weighted value, M denotes the total number of the pixel blocks in the X-axis direction, and N denotes the total number of the pixel blocks in the Y-axis direction.

In the above circuit, the voltage drop calculator includes a first multiplier configured to multiply the average current value of the reference pixel block corresponding to the coordinate (m, n) and the X-axis voltage drop distribution coefficient corresponding to the coordinate (x, y) so as to output a first result, a second multiplier configured to multiply the first result corresponding to the coordinate (m, n) and the Y-axis voltage drop weighted value corresponding to the coordinate (m, n) so as to output a second result, and an adder configured to sum a plurality of second results for each coordinate (m, n) so as to output the pixel block voltage drop of each of the target pixel blocks.

In the above circuit, the pixel blocks include center pixels each located at a center of each of the pixel blocks, wherein the interpolator is further configured to i) set the pixel voltage drop of each of the center pixels to be the pixel block voltage drop of each of the target pixel blocks, and ii) perform a bilinear interpolation operation on the pixel voltage drops of four center pixels that are adjacent to the target pixel so as to estimate the pixel voltage drop of a target pixel selected among one of the target pixel blocks.

In the above circuit, the compensated data generator includes a maximum value detector configured to detect a maximum voltage drop among the pixel block voltage drops of the target pixel blocks in one frame, a comparator configured to calculate a delta value that is the difference between the maximum voltage drop and the pixel voltage drop of the target pixel, and a subtractor configured to subtract the delta value from the data voltage of the input image data so as to generate the compensated data voltage.

In the above circuit, the maximum value detector is configured to set the maximum voltage drop to be a predetermined value.

The above circuit further comprises a common voltage drop calculator configured to i) calculate a total current value that is the sum of the average current values of the pixel blocks and ii) calculate a common voltage drop of the display panel based at least in part on the total current.

In the above circuit, the compensated data generator is configured to generate the compensated data voltage based at least in part on respective values, wherein each of the respective values corresponds to the sum of the common voltage drop and the pixel block voltage drop of each of the target pixel block.

In the above circuit, the common voltage drop calculator is further configured to deactivate the compensated data generator when the total current is less than a predetermined reference value.

Another aspect is an organic light-emitting diode (OLED) display comprising a display panel including M×N pixel blocks each having a plurality of pixels, where M and N are positive integers, wherein a plurality of target pixel blocks are selected among the pixel blocks. The display also comprises a data compensator configured to generate a compensated data voltage based at least in part on pixel block voltage drops of each of the pixel blocks, wherein the data compensator is further configured to calculate the pixel block voltage drops based at least in part on an X-axis voltage drop and a Y-axis voltage drop of each of the target pixel blocks. The display further comprises a scan driver configured to transmit a scan signal to the display panel, a data driver configured to transmit the compensated data voltage to the display panel, a timing controller configured to control the scan driver and the data driver, and a power supply configured to supply a first power voltage and a second power voltage to the display panel.

In the above display, the data compensator includes an average current calculator configured to calculate the average current value of each of the pixel blocks based at least in part on input image data and a voltage drop calculator configured to calculate the pixel block voltage drops of the first power voltage of each of the target pixel blocks based at least in part on the product of an Y-axis voltage drop weighted value and a X-axis voltage drop distribution coefficient. The data compensator further includes an interpolator configured to interpolate the pixel block voltage drops of adjacent target pixel blocks so as to calculate a pixel voltage drop of a selected target pixel of each of the target pixel blocks. The data compensator further includes a compensated data generator configured compensate a data voltage of the input image data based at least in part on the pixel voltage drop so as to generate the compensated data voltage.

In the above display, the product of the Y-axis voltage drop weighted value and the X-axis voltage drop distribution coefficient corresponds to an amount of a current flowing into each of the target pixel blocks when a unit current is applied to a selected reference pixel block of the pixel blocks.

In the above display, the X-axis voltage drop distribution coefficient is a normalized value of the X-axis voltage drop of each of the target pixel blocks located at a coordinate (x, y), when the unit current is applied to the reference pixel block located at a coordinate (m, n), where x and m are positive integers less than or equal to M, and where y and n are positive integers less than or equal to N.

In the above display, the voltage drop calculator is further configured to calculate the pixel block voltage drop of each of the target pixel blocks based on the following Equation:

$$Vdrop(x, y) = Rs \times \sum_{m=1}^{M} \sum_{n=1}^{N} Imn \times Smn(x, y) \times Yn,$$

where Rs denotes a resistance coefficient, Imn denotes the average current value of the reference pixel block corresponding to the coordinate (m, n), Smn(x, y) denotes the X-axis voltage drop distribution coefficient corresponding to the coordinate (x, y) selected among the target pixel blocks when the unit current flows through the reference pixel block, Yn denotes the Y-axis voltage drop weight, M denotes the total number of the pixel blocks in the X-axis direction, and N denotes the total number of the pixel blocks in the Y-axis direction.

According to at least one of the disclosed embodiments, the data compensating apparatus and the OLED display having the same according to example embodiments can compensate the data voltage of the input image data R, G, and B reflecting the X-axis voltage drop and the Y-axis voltage drop (i.e., the voltage drops in the X-axis and Y-axis directions) by using the simple hardware circuit and the predetermined X-axis voltage drop distribution coefficient Smn(x, y), so that the voltage drop of the pixel block and/or pixel can be calculated relatively accurately than typical techniques. Thus, unevenness of the luminance and image degradation with the voltage drop across power lines can be significantly improved.

DETAILED DESCRIPTION OF CERTAIN INVENTIVE EMBODIMENTS

A voltage drop (IR-drop) across wires (e.g., power lines) for supplying voltages and data signals to pixels in a display panel can degrade image quality. A voltage less than that initiated by a driver circuit is supplied to the pixels due to the voltage drop across the wires. The lower voltage affects the amount of current flowing through a driving TFT, degrading the long range uniformity (LRU) of the display device. Methods for compensating for the voltage drop are being developed, but they have limitations on accurately calculating the voltage drop. As a result, images displayed by the compensated data can be insufficiently corrected.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1A:
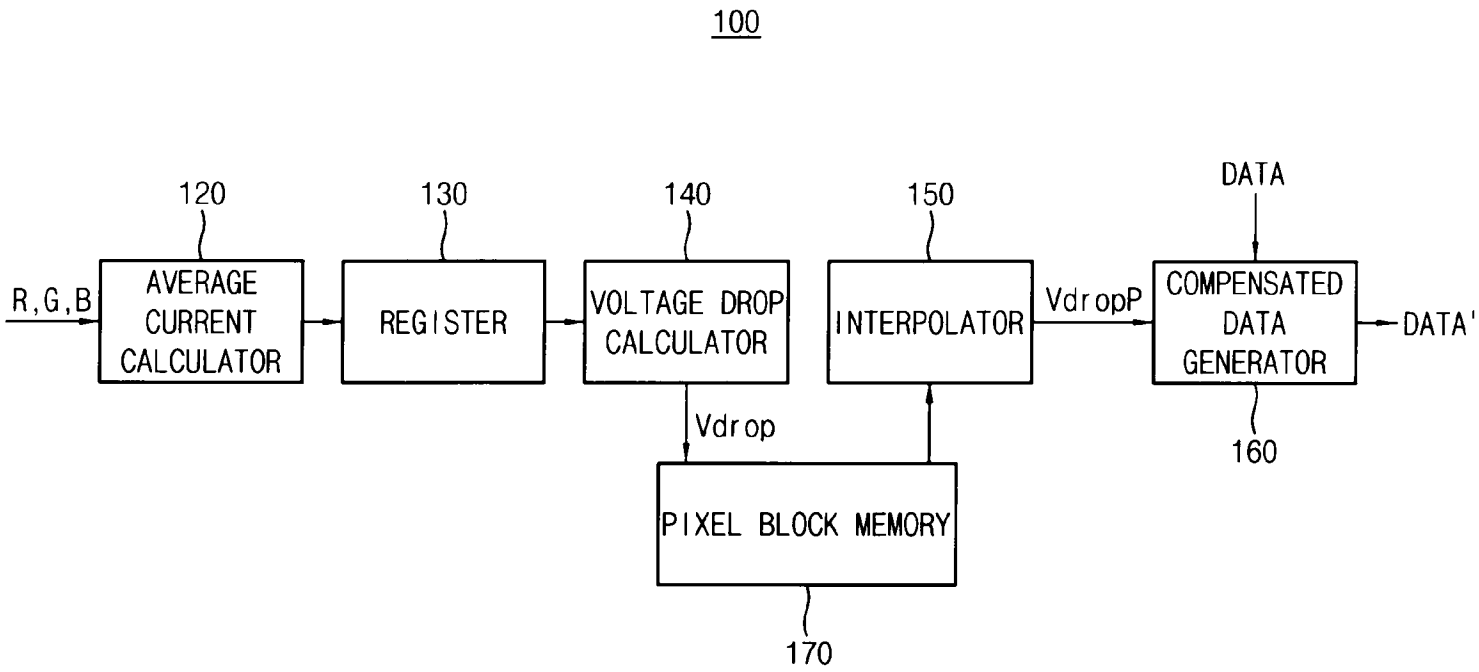
FIG. 1A is a block diagram of a data compensating apparatus according to example embodiments.
Figure 1B:
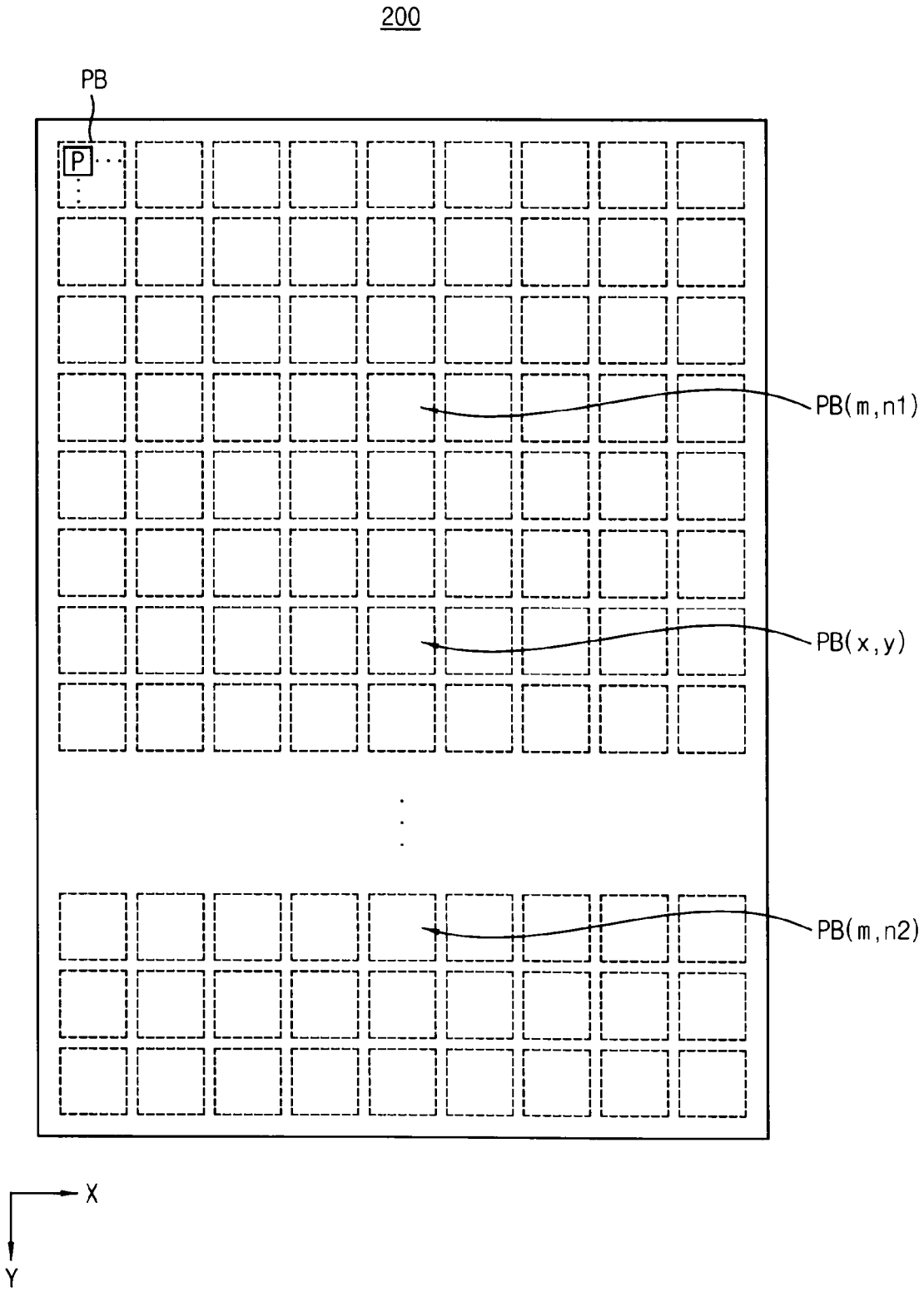
FIG. 1B illustrates an example of a display panel driven by the data compensating apparatus of FIG. 1A.
Figure 1C:
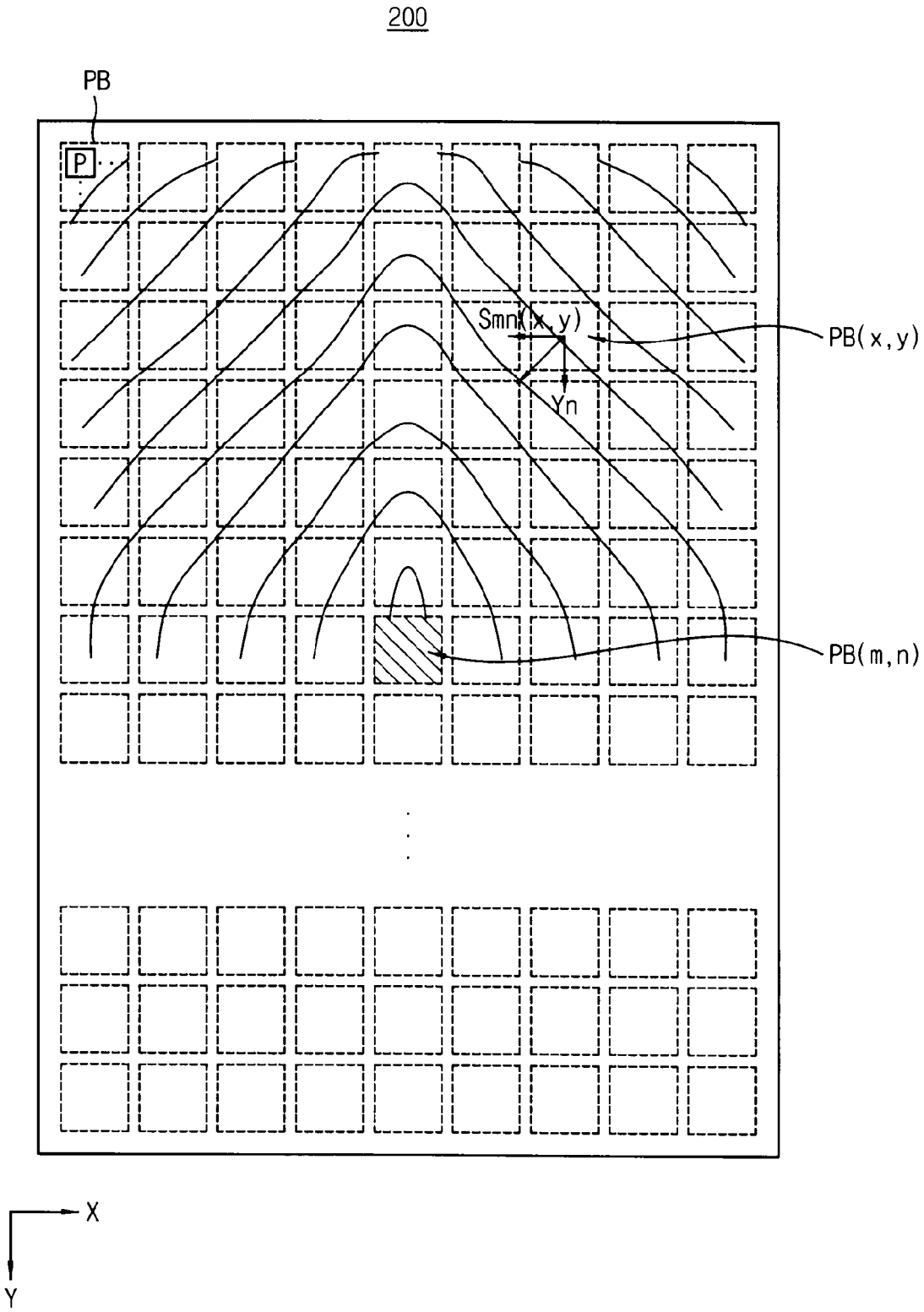
FIG. 1C illustrates an example of when a unit current is applied to a reference pixel block in a display panel based on an operation of the data compensating apparatus of FIG. 1A.

FIG. 1A is a block diagram of a data compensating apparatus according to example embodiments. FIG. 1B illustrates an example of a display panel driven by the data compensating apparatus of FIG. 1A. FIG. 1C illustrates an example of when a unit current is applied to a reference pixel block in a display panel based on an operation of the data compensating apparatus of FIG. 1A.

Referring to FIGS. 1A to 1C, the data compensating apparatus 100 includes an average current calculator 120, a voltage drop calculator 140, an interpolator 150, and a compensated data generator 160. A display panel 200 can be divided into M×N pixel blocks PB, where M and N are positive integers, each having a plurality of pixels P. In some embodiments, respective the pixel blocks PB include the same number of pixels.

The average current calculator 120 can calculate an average current of each of the pixel blocks PB based on input image data R, G, and B receiving from an external device. In some embodiments, the average current calculator 120 estimates a pixel current at each pixel P based on a gamma conversion value of the input image data R, G and B during one frame. The average current calculator 120 can calculate an average value of estimated pixel currents of the pixels P in each pixel block PB. In some embodiments, the average currents are temporarily stored in a register 130.

The register 130 can store the average current values of each of the pixel blocks PB in the one frame. In some embodiments, the register 130 includes M storing blocks corresponding to the number of pixel blocks PB in the X-axis direction (or in the row direction).

The pixel block is, as illustrated in FIG. 1B, one of divided areas of the display panel 200 displaying an image. For example, the display panel 200 includes 1,080 pixels P in the X-axis direction (or a horizontal direction) and 1,920 pixels P in the Y-axis direction (or the vertical direction) when the display panel 200 of FIG. 1B implements Full-HD image. Each of the pixels P can include 3 sub-pixels (e.g., R sub-pixel, G sub-pixel, and B sub-pixel). The number of total pixels can be 1,080×1,920 pixels.

In this, each pixel block PB can include 120×120 pixels P so that the display panel 200 can include 9 pixel blocks (=1,080/120) in the X-axis direction and 16 pixel blocks (=1,920/120) in the Y-axis direction. The pixel block corresponding to a coordinate (x, y) will be represented in PB(x, y).

The voltage drop calculator 140 can calculate pixel block voltage drops of power voltage of each of target pixel blocks PB(x, y) according to an X-axis voltage drop and a Y-axis voltage drop of the each of the target pixel blocks based on a product of a Y-axis voltage drop weighted value Yn and an X-axis voltage drop distribution coefficient Smn(x, y). The target pixel blocks PB(x, y) can be selected among the pixel blocks PB. A target pixel block PB(x, y) can mean a pixel block at which the pixel block voltage drop of the power voltage is calculated. As illustrated in FIG. 1C, the power voltage is provided to the display panel 200 through a power line. Resistance of the power line can induce the voltage drops (e.g., IR-drop) in the Y-axis direction (i.e., the Y-axis voltage drop) so that a pixel current at the pixel P decreases in the Y-axis direction and luminance of the pixel decreases. In addition, the current flowing into the display panel 200 can be dispersed so that undesired voltage drop can be generated in the X-axis direction (i.e., the X-axis voltage drop). FIG. 1C shows equipotential lines according to the Y-axis voltage drop and the X-axis voltage drop when a unit current is applied to the reference pixel block PB(m, n) that is selected among the pixel blocks PB. Thus, the voltage drop calculator 140 can calculate the pixel block voltage drops Vdrop of the pixel blocks PB in consideration of the Y-axis voltage drop and the X-axis voltage drop of the power voltage. The unit current can be defined as about 1 A. In some embodiments, the pixel block voltage drop Vdrop corresponds to a voltage difference between the power voltage output from a power supply included in a display device and the power voltage applied at the target pixel block PB(x, y).

In some embodiments, the product of the Y-axis voltage drop weighted value Yn and the X-axis voltage drop distribution coefficient Smn(x, y) corresponds to an amount of a current flowing into each of the target pixel blocks PB(x, y) when the unit current is applied to the reference pixel block PB(m, n) that is selected among the pixel blocks PB. The Y-axis voltage drop weighted value Yn can be a weighted value of the Y-axis voltage drop of each of the target pixel blocks PB(x, y) when the unit current is applied to the reference pixel block PB(m, n). The X-axis voltage drop distribution coefficient Smn(x, y) can be a normalized value of the X-axis voltage drop of one of the target pixel blocks PB(x, y) located at a coordinate (x, y) when the unit current is applied to the reference pixel block PB(m, n) located at a coordinate (m, n). For example, amounts of the X-axis voltage drops (or the voltage drops in the X-axis direction) in the same row are different from each other when the unit current is applied to the specific reference pixel block PB(m, n). The X-axis voltage drop distribution coefficient Smn(x, y) can mean differences of the X-axis voltage drops of each pixel block PB in the same row. In some embodiments, the X-axis voltage drop distribution coefficient Smn(x, y) corresponding to a pixel block coordinate value is stored in a lookup table.

In some embodiments, the voltage drop calculator 140 includes at least one multiplier and an adder. For example, the voltage drop calculator 140 accurately calculates the pixel block voltage drop Vdrop of the pixel block PB according to simple hardware constructions. Structures and operations of the voltage drop calculator 140 and the X-axis voltage drop distribution coefficient Smn(x, y) will be described more fully with reference to FIGS. 2 to 5. The pixel block voltage drops Vdrop of the pixel blocks PB calculated in the voltage drop calculator 140 can be provided to the interpolator 150.

The interpolator 150 can calculate a pixel voltage drop VdropP of a target pixel by interpolating the pixel block voltage drops Vdrop of adjacent ones of the target pixel blocks PB(x, y). Thus, the interpolator 150 can calculate pixel voltage drops VdropP of the pixels P included in the display panel 200 using the voltage drops Vdrop of the target pixel blocks PB(x, y). The pixel blocks PB can include center pixels each located at a center of each of the pixel blocks PB. In some embodiments, the interpolator 150 sets the pixel voltage drop VdropP of each of the center pixels to be the pixel block voltage drop Vdrop of each of the target pixel blocks PB(x, y), and estimates the pixel voltage drop VdropP of the target pixel by performing a bilinear interpolation on the pixel voltage drops VdropP of four center pixels that are adjacent to the target pixel. The interpolator 150 can provide the pixel voltage drop VdropP to the compensated data generator 160.

In some embodiments, the data compensating apparatus 100 further includes a pixel block memory 170. The pixel block memory 170 can store the pixel block voltage drops Vdrop output from the voltage drop calculator 140. The pixel block memory 170 can include at least one register block corresponding to at least one pixel block PB.

In some embodiments, the compensated data generator 160 generates a compensated data voltage DATA' by compensating the data voltage of the input image data R, G, and B based on the pixel voltage drop VdropP. In example embodiments, the compensated data generator 160 generates the compensated data voltage DATA' based on the pixel voltage drop VdropP and a comparison result between the pixel block voltage drops Vdrop of the pixel blocks PB and a maximum value of the pixel block voltage drops Vdrop of the pixel blocks PB. In some embodiments, the compensated data generator 160 includes a maximum value detector detecting a maximum voltage drop among the pixel block voltage drops Vdrop of the target pixel blocks PB(x, y) in one frame, a comparator calculating a delta value that is a difference between the maximum voltage drop and the pixel voltage drop VdropP of the target pixel, and a subtractor generating the compensated data voltage DATA' by subtracting the delta value from the data voltage of the input image data R, G, and B. For example, the compensated data generator 160 compensates the voltage data by using the following Equation 1. In this, a driving transistor of the pixel can be a P-channel metal oxide semiconductor field effect transistor (P-channel MOSFET).

$$DATA' = DATA - \Delta V \quad (1)$$

Here, DATA' is the compensated data voltage applied to one of the pixels, DATA is an original data voltage of a corresponding pixel P, ΔV is the delta value of the corresponding pixel P. For example, the delta value ΔV corresponds to the pixel voltage drop or a proportionally changed value of the pixel voltage drop based on the maximum voltage drop. The compensated data voltage DATA' can decrease according to the pixel voltage drop of the pixel P. Thus, an OLED included in the pixel P can emit light based on a pixel current that compensate the pixel voltage drop 2-dimensionally.

In contrast, the driving transistor of the pixel P can be an N-channel MOSFET. The compensated data generator 160 can compensate the voltage data by using following Equation 2.

$$DATA' = DATA + \Delta V \quad (2)$$

The compensated data voltage DATA' can increase according to the pixel voltage drop of the pixel P. Thus, the OLED included in the pixel P can emit light based on the pixel current that compensate the pixel voltage drop 2-dimensionally.

In some embodiments, the compensated data generator 160 fixes the maximum voltage drop to be a predetermined value. For example, the fixed value is the maximum voltage drop when the display panel 200 emits full-white light, and the compensated data generator 160 generates the compensated data voltage DATA' based on the fixed value. In this case, a maximum luminance of the display panel 200 can be maintained in a specific luminance level. Structures and operations of the compensated data generator 160 will be described more fully with reference to FIGS. 7 and 8. In some embodiments, the compensated data generator 160 provides the compensated data voltage DATA' to a data driver of the display device.

As described above, the data compensating apparatus 100 of FIG. 1 can compensate the data voltage of the input image data R, G, and B in accordance with the X-axis voltage drop and the Y-axis voltage drop (i.e., the voltage drops in the X-axis and Y-axis directions) by using the simple hardware circuit and the predetermined X-axis voltage drop distribution coefficient Smn(x, y), so that the voltage drop of the pixel block PB and/or pixel can be calculated relatively accurately than typical techniques. Thus, unevenness of the luminance and image degradation with the voltage drop across power lines can be significantly improved.

Figure 2:
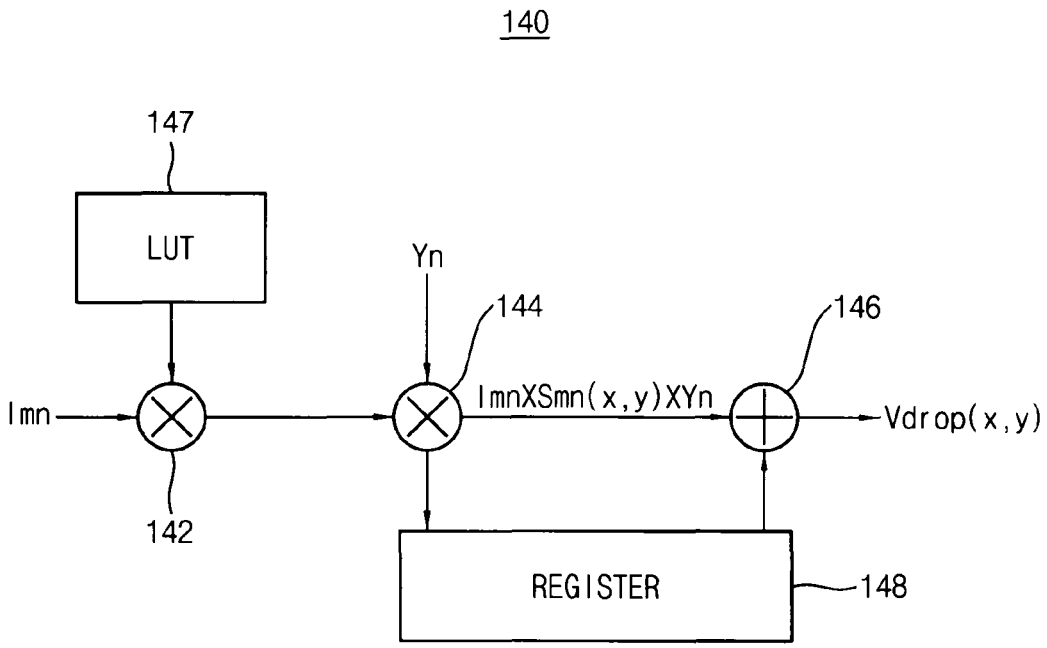
FIG. 2 illustrates an example of a voltage drop calculator included in the data compensating apparatus of FIG. 1A.

FIG. 2 illustrates an example of a voltage drop calculator included in the data compensating apparatus of FIG. 1A.

Referring to FIGS. 1A to 2, the voltage drop calculator 140 includes a first multiplier 142, a second multiplier 144, and an adder 146. The voltage drop calculator 140 can further include a lookup table 147 storing a plurality of X-axis voltage drop distribution coefficients Smn(x, y) and a register 148 for temporarily storing the pixel block voltage drops at respective the pixel blocks PB.

In some embodiments, the voltage drop calculator 140 calculates the pixel block voltage drop Vdrop(x, y) of each of the target pixel blocks PB(x, y) using Equation 3 below, $$Vdrop(x, y) = Rs \times \sum_{m=1}^{M} \sum_{n=1}^{N} Imn \times Smn(x, y) \times Yn, \quad (3)$$

where Rs denotes a resistance coefficient, Imn denotes the average current of a reference pixel block corresponding to a coordinate (m, n) selected among the pixel blocks, Smn(x, y) denotes the X-axis voltage drop distribution coefficient corresponding to a coordinate (x, y) selected among the target pixel blocks when a unit current flows through the reference pixel block, Yn denotes the Y-axis voltage drop weighted value, M denotes total number of the pixel blocks in the X-axis direction, and N denotes total number of the pixel blocks in the Y-axis direction. For example, M and N respectively correspond to 9 and 16 when each pixel block includes 120 by 120 pixels.

In some embodiments, the X-axis voltage drop distribution coefficient Smn(x, y) is a normalized value of an X-axis voltage drop of one of the target pixel blocks PB(x, y) located at the coordinate (x, y) when the unit current is applied to the reference pixel block PB(m, n) located at the coordinate (m, n), where m is a positive integer less than or equal to M, and n is a positive integer less than or equal to N. Here, the X-axis voltage drop means a voltage drop in the X-axis direction of the target pixel block PB(x, y) when the unit current is applied to the reference pixel block PB(m, n). An amount of the X-axis voltage drop of the target pixel block PB(x, y) can be calculated by multiplying the resistance coefficient Rs by the average current Imn applying the X-axis voltage drop distribution coefficient Smn(x, y).

The first multiplier 142 can output first results (i.e., represented in Imn*Smn(x, y) of FIG. 2) by multiplying the average current Imn of the reference pixel block PB(m, n) corresponding to the coordinate (m, n) by the X-axis voltage drop distribution coefficient Smn(x, y) corresponding to the coordinate (x, y). The first multiplier 142 can receive the average current Imn from the average current calculator 120, and receive the X-axis voltage drop distribution coefficient Smn(x, y) from the lookup table 147.

The second multiplier 144 can output second results (i.e., represented in Imn*Smn(x, y)*Yn of FIG. 2) by multiplying each of the first results Imn*Smn(x, y) corresponding to the coordinate (m, n) by the Y-axis voltage drop weighted value Yn corresponding to the coordinate (m, n). The second results can be temporarily stored in the register 148. The Y-axis voltage drop weighted value Yn can be a weighted value of the Y-axis voltage drop of each of the target pixel blocks PB(x, y) when the unit current (e.g., 1 A current) is applied to the reference pixel block PB(m, n) that is selected among the pixel blocks. Here, the Y-axis voltage drop means a voltage drop in the Y-axis direction of the target pixel block PB(x, y) when the unit current is applied to the reference pixel block PB(m, n). Thus, the pixel block voltage drop Vdrop(x, y) of the target pixel block PB(x, y) can be calculated by multiplying the resistance coefficient Rs by the average current Imn applying the X-axis voltage drop distribution coefficient Smn(x, y) and the Y-axis voltage drop weighted value Yn (i.e., Imn*Smn(x, y)*Yn). The pixel block voltage drop Vdrop(x, y) can include the Y-axis voltage drop of the target pixel block PB(x, y) and the X-axis voltage drop of the target pixel block PB(x, y). In some embodiments, the voltage drop calculator 140 sets the Y-axis voltage drop weighted value Yn to have a Y-coordinate value of the reference pixel block PB(m, n) when the Y-coordinate value of the reference pixel block PB(m, n) is less than a Y-coordinate value of each of target pixel blocks PB(x, y). In some embodiments, the voltage drop calculator 140 sets the Y-axis voltage drop weighted value Yn to have the Y-coordinate value of each of the target pixel blocks PB(x, y) when the Y-coordinate value of the reference pixel block PB(m, n) is greater than or equal to the Y-coordinate value of the target pixel block PB(x, y). Thus, the Y-axis voltage drop weighted value Yn can be given by Equation 4:

$$Yn = \begin{Bmatrix} n, & (n < y) \\ y, & (n \geq y) \end{Bmatrix}, \tag{4}$$

where n is a Y-coordinate value of the reference pixel block PB(m, n) and y is a Y-coordinate value of the target pixel block PB(x, y). For example, as illustrated in FIG. 1B, y is greater than n1 and less than n2. Thus, the second multiplier 144 can output the second result corresponding to a coordinate (m, n1) to be Imn1*Smn1(x, y)*n1, and output the second result corresponding to a coordinate (m, n2) to be Imn2*Smn2(x, y)*y. As a result, the Y-axis voltage drop weighted value Yn can be a weighted value of a Y-axis voltage drop of each of the target pixel blocks PB(x, y) when the unit current (e.g., 1 A current) is applied to the reference pixel block PB(m, n) so that the Y-axis voltage drop can substantially linearly increase when the Y-coordinate n of the reference pixel block PB(m, n) is less than the Y-coordinate y of the target pixel block PB(x, y). However, in some embodiments, the current is not applied to the target pixel block PB(x, y) when the Y-coordinate n of the reference pixel block PB(m, n) is greater than the Y-coordinate y of the target pixel block PB(x, y), so that the Y-axis voltage drop can be stably maintained at the target pixel block PB(x, y). Thus, the Y-axis voltage drop weighted value Yn can be set by Equation 3.

The adder 146 can output the pixel block voltage drop Vdrop(x, y) of each of the target pixel blocks PB(x, y) by summing up the second results Imn*Smn(x, y)*Yn. For example, the adder 146 calculates the pixel block voltage drop Vdrop(x, y) of the target pixel block PB(x, y) by summing up the second results stored in the register 148. For example, by adapting Equation 3 and Equation 4, the pixel block voltage drop Vdrop(2, 5) of the target pixel block PB(2, 5) is given by Equation 5:

$$\begin{aligned} Vdrop(2, 5) = {} & Rs \times \Bigg( \sum_{m=1}^{M} Im1 \times Sm1(2, 5) \times 1 + \sum_{m=1}^{M} Im2 \times Sm2(2, 5) \times 2 + \\ & \sum_{m=1}^{M} Im3 \times Sm3(2, 5) \times 3 + \ldots + \sum_{m=1}^{M} Im5 \times Sm5(2, 5) \times 5 + \\ & \sum_{m=1}^{M} Im6 \times Sm6(2, 5) \times 5 + \ldots + \sum_{m=1}^{M} ImN \times SmN(2, 5) \times 5 \Bigg). \end{aligned} \tag{5}$$

The lookup table 147 can include a plurality of predetermined X-axis voltage drop distribution coefficients Smn(x, y). Thus, the voltage drop calculator 140 can select the X-axis voltage drop distribution coefficient Smn(x, y) corresponding to specific coordinates of the reference pixel block PB(n, n) and the target pixel block PB(x, y) from the lookup table 147. The voltage drop calculator 140 can control the operation of the first multiplier 142 based on the X-axis voltage drop distribution coefficient Smn(x, y) and the average current Imn.

In some embodiments, the register 148 includes a plurality of storing blocks for storing the second results each corresponding to the coordinates of the pixel blocks PB in one frame. The adder 146 can sum up the second results using the register 148.

As described above, the voltage drop calculator 140 can calculate the pixel block voltage drop Vdrop(x, y) in the X-axis and Y-axis directions of the target pixel block PB(x, y).

Figure 3:
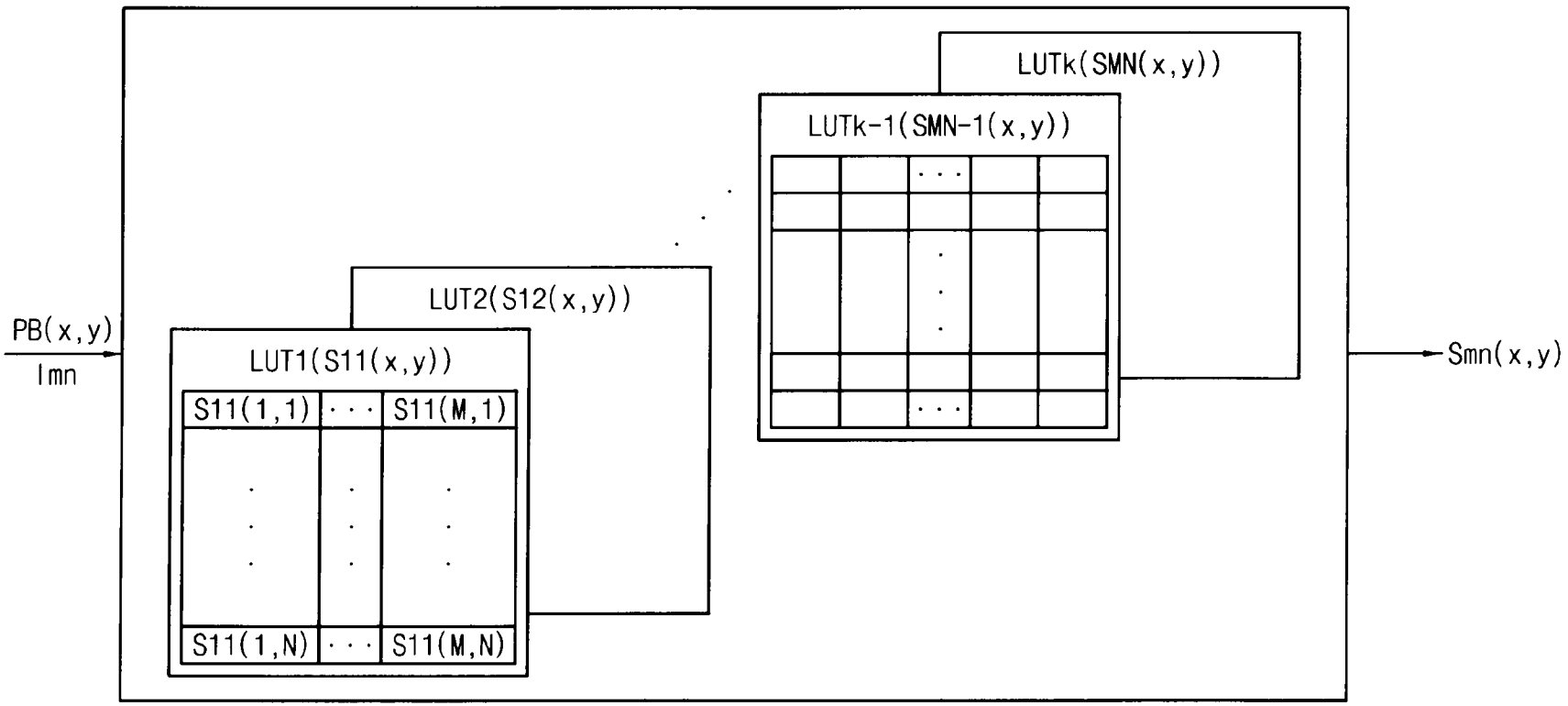
FIG. 3 illustrates an example of a lookup table storing X-axis voltage drop distribution coefficients included in the data compensating apparatus of FIG. 1A.

FIG. 3 illustrates an example of a lookup table storing X-axis voltage drop distribution coefficients included in the data compensating apparatus of FIG. 1A.

Referring to FIG. 3, the voltage drop calculator 140 includes a plurality of predetermined lookup tables LUT1 through LUTk. The lookup tables LUT1 through LUTk can have a plurality of X-axis voltage drop distribution coefficients Smn(x, y) each corresponding to a coordinate value of the pixel block.

The voltage drop calculator 140 can select one of the lookup tables LUT1 through LUTk according to the coordinate of the target pixel block PB(x, y) and further select one of the X-axis voltage drop distribution coefficients Smn(x, y) from the selected lookup table according to the coordinate of the reference pixel block PB(m, n). For example, the voltage drop calculator 140 selects the X-axis voltage drop distribution coefficients S11(2, 5) from a first lookup table LUT1 when the coordinate of the target pixel block PB(x, y) is PB(2, 5) to calculate the pixel block voltage drop of the target pixel block PB(x, y) and the coordinate of the reference pixel block PB(m, n) is PB(1, 1). The X-axis voltage drop distribution coefficient Smn(x, y) can be a normalized value of the X-axis voltage drop of one of the target pixel blocks PB(x, y) in the same row of the pixel blocks when the unit current is applied to the reference pixel block PB(m, n) located at the coordinate (m, n). Thus, sum of all the X-axis voltage drop distribution coefficients Smn(x, y) in the same row of the pixel blocks can be 1.

The first multiplier 142 can calculate the first result based on the selected X-axis voltage drop distribution coefficient Smn(x, y) from the lookup tables LUT1 through LUTk.

Figure 4A:
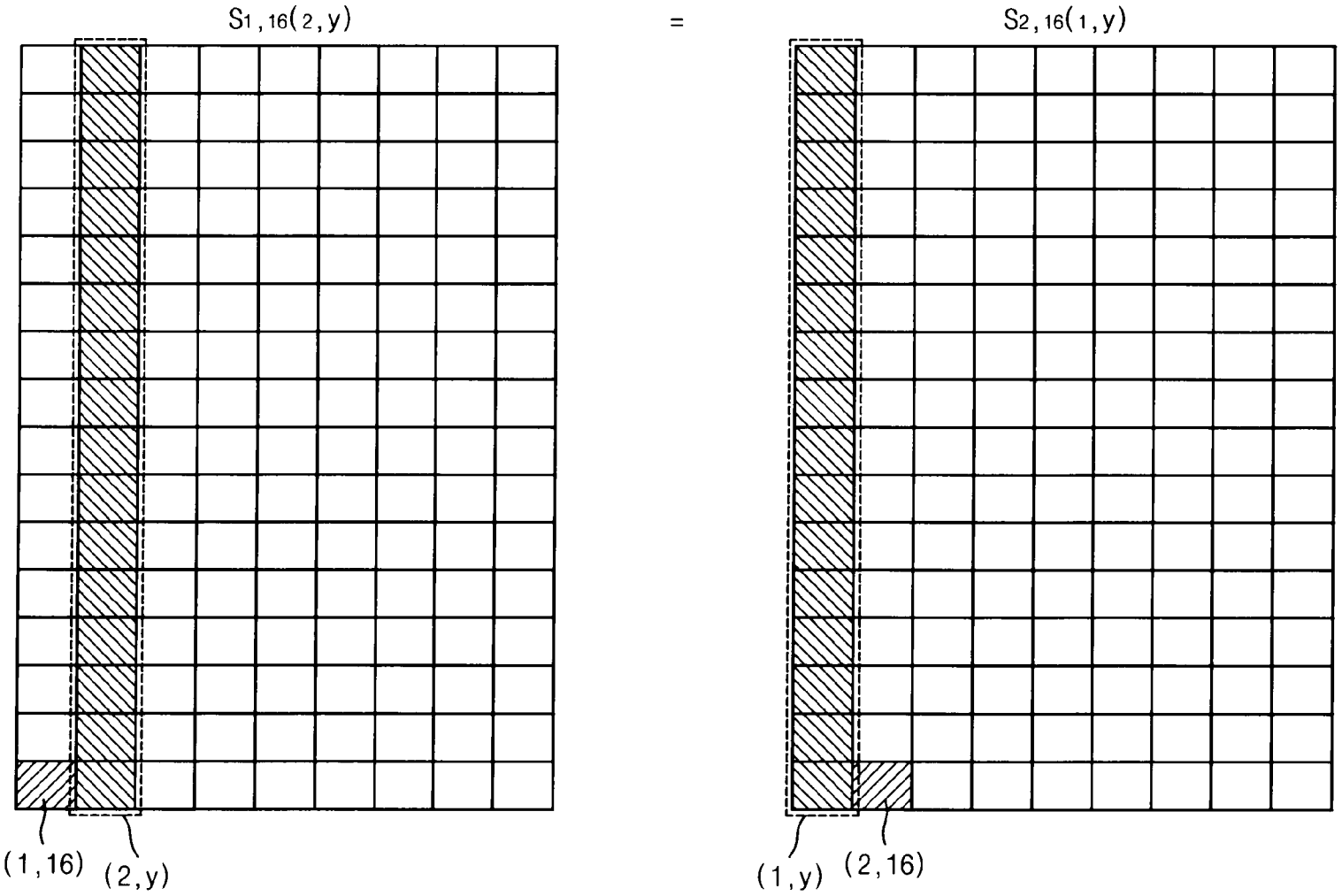
FIG. 4A illustrates an example of forming the lookup table of FIG. 3.
Figure 4B:
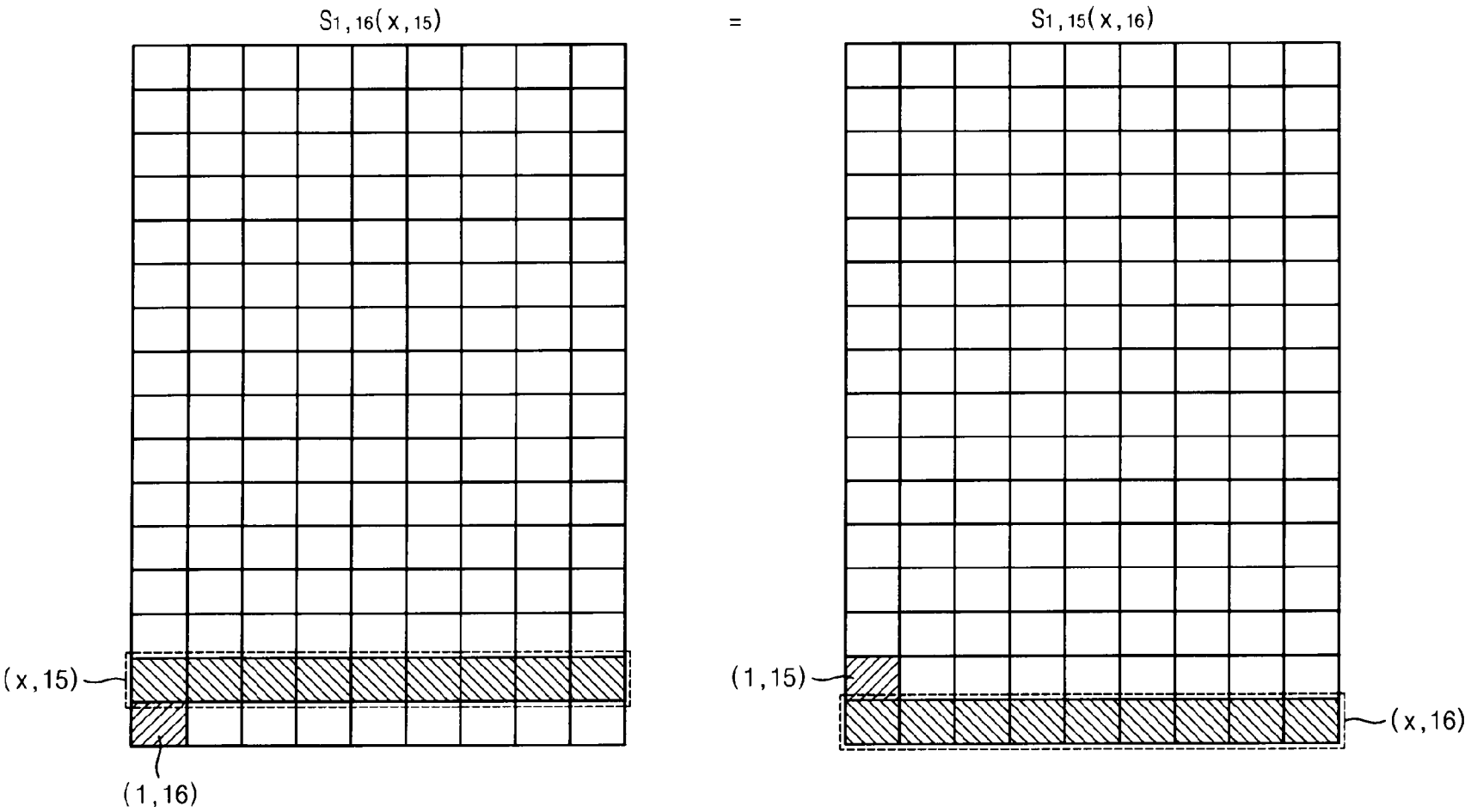
FIG. 4B illustrates another example of forming the lookup table of FIG. 3.
Figure 4C:
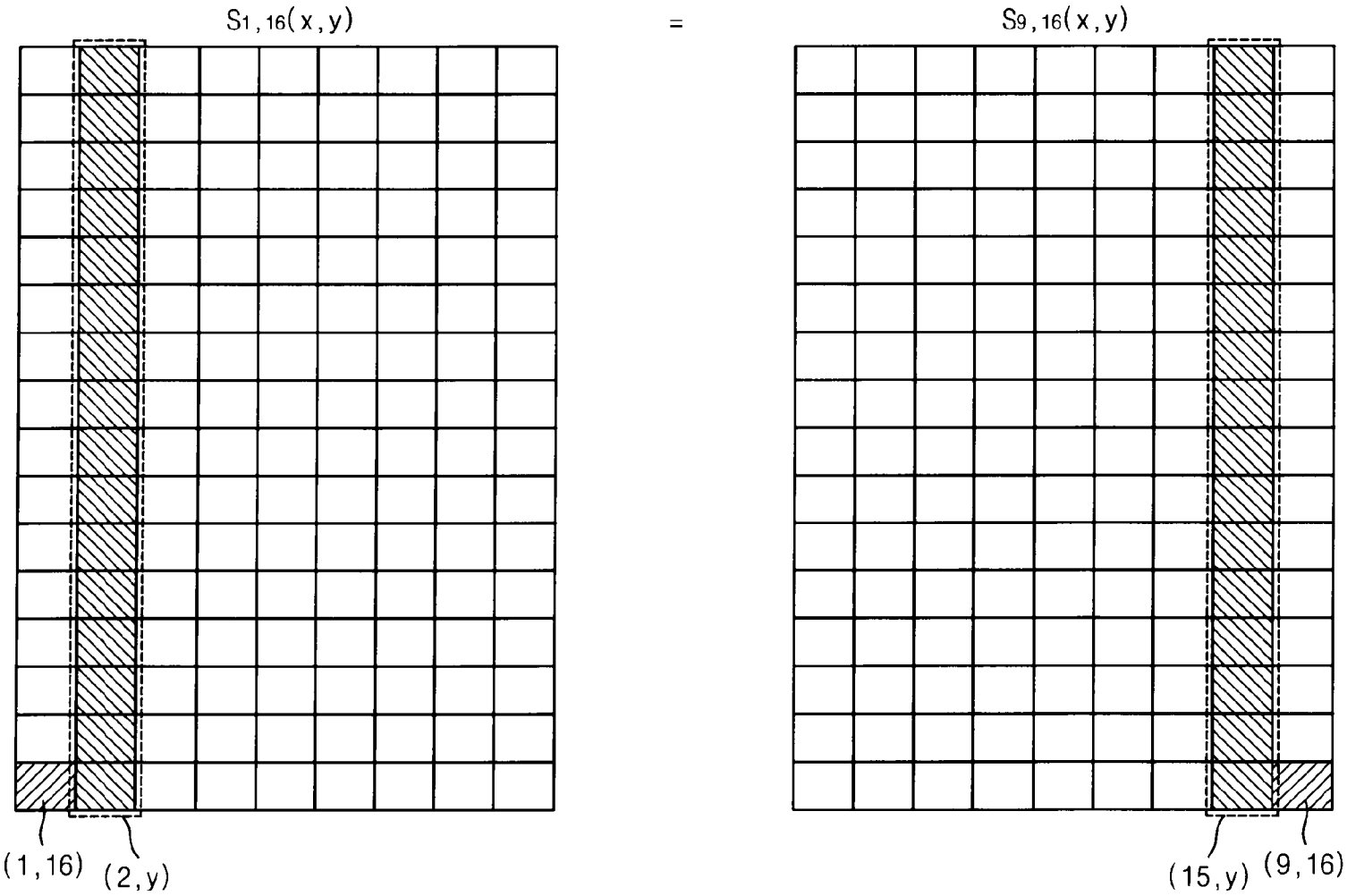
FIG. 4C illustrates still another example of forming the lookup table of FIG. 3.

FIG. 4A illustrates an example of forming the lookup table of FIG. 3. FIG. 4B illustrates another example of forming the lookup table of FIG. 3. FIG. 4C illustrates still another example of forming the lookup table of FIG. 3.

Referring to FIGS. 2 through 4C, the X-axis voltage drop distribution coefficients Smn(x, y) is set in the lookup table 147 according to the coordinate (m, n) of the reference pixel block PB(m, n) and the coordinate (x, y) of the target pixel block PB(x, y).

In some embodiments, a first X-axis voltage drop distribution coefficient is substantially equal to a second X-axis voltage drop distribution coefficient. In this, the first X-axis voltage drop distribution coefficient can be the X-axis voltage drop distribution coefficient of each of the target pixel blocks located at a second X-coordinate when the unit current is applied to the reference pixel block located at a first X-coordinate. Further, the second X-axis voltage drop distribution coefficient can be the X-axis voltage drop distribution coefficient of each of the target pixel blocks located at the first X-coordinate when the unit current is applied to the reference pixel block located at the second X-coordinate. For example, the X-axis voltage drop distribution coefficient set by the voltage drop calculator 140 is given by Equation 6:

$$Smn(x,y)=Sxn(m,y), \quad (6)$$

where m is the first X-coordinate value and x is the second X-coordinate value. As illustrated in FIG. 4A, the X-axis voltage drop distribution coefficient S1,16(2, y) can be substantially equal to the X-axis voltage drop distribution coefficient S2,16(1, y). Here, the first X-coordinate can correspond to 1 and the second X-coordinate can correspond to 2.

In some embodiments, the first X-axis voltage drop distribution coefficient is substantially equal to the second X-axis voltage drop distribution coefficient. In this, the first X-axis voltage drop distribution coefficient can be the X-axis voltage drop distribution coefficient of each of the target pixel blocks located at a second Y-coordinate when the unit current is applied to the reference pixel block located at a first Y-coordinate. Further, the second X-axis voltage drop distribution coefficient is the X-axis voltage drop distribution coefficient of each of the target pixel blocks located at the first Y-coordinate when the unit current is applied to the reference pixel block located at the second Y-coordinate. For example, the X-axis voltage drop distribution coefficient set by the voltage drop calculator 140 can be given by Equation 7:

$$Smn(x,y)=Smy(x,n), \quad (7)$$

where n is the first Y-coordinate value and y is the second Y-coordinate value. As illustrated in FIG. 4B, the X-axis voltage drop distribution coefficient S1,16(x, 15) substantially equal to the X-axis voltage drop distribution coefficient S1,15(x, 16). Here, the first Y-coordinate can correspond to 16 and the second Y-coordinate can correspond to 15.

In some embodiments, a third X-axis voltage drop distribution coefficient is substantially equal to a fourth X-axis voltage drop distribution coefficient. In this, the third X-axis voltage drop distribution coefficient can correspond to a coordinate of a first reference pixel block and a coordinate of a first target pixel block. Further, the fourth X-axis voltage drop distribution coefficient can correspond to a coordinate of a second reference pixel block and a coordinate of a second target pixel block. The first and second reference pixel blocks can be substantially symmetric with respect to a center column among the pixel blocks, and the first and second target pixel blocks can be substantially symmetric with respect to the center column. For example, the X-axis voltage drop distribution coefficient set by the voltage drop calculator 140 can be given by Equation 8:

$$Smn(x,y)=Sm'n(x',y), \quad (8)$$

where m'=M+1−m and x'=M+1−x. As illustrated in FIG. 4C, the X-axis voltage drop distribution coefficient S1,16(2, y) is substantially equal to the X-axis voltage drop distribution coefficient S9,15(15, y) when M is 9, where M is the total number of the pixel blocks in the X-axis direction.

In some embodiments, the X-axis voltage drop distribution coefficients Smn(x, y) are set in the lookup table 147 by applying at least one of the Equation 6 through Equation 8. Thus, the actual number of the X-axis voltage drop distribution coefficients Smn(x, y) and a size of the lookup table 147 can decrease such that the voltage drop calculator 140 can select the proper X-axis voltage drop distribution coefficient Smn(x, y) by using a coordinate conversion. For example, 20,736 (i.e., (9*16)*(9*16)=20,736) X-axis voltage drop distribution coefficients Smn(x, y) are necessary to calculating the voltage drops of the target pixel blocks when the display panel includes 9×16 pixel blocks. However, the X-axis voltage drop distribution coefficients Smn(x, y) of all pixel block can be calculated by using only 3,400 (i.e., (1+2+3+ . . . +15+16)*(1+3+5+7+9)=3,400) predetermined X-axis voltage drop distribution coefficients Smn(x, y) when the Equation 6 through Equation 8 are applied.

Figure 5:
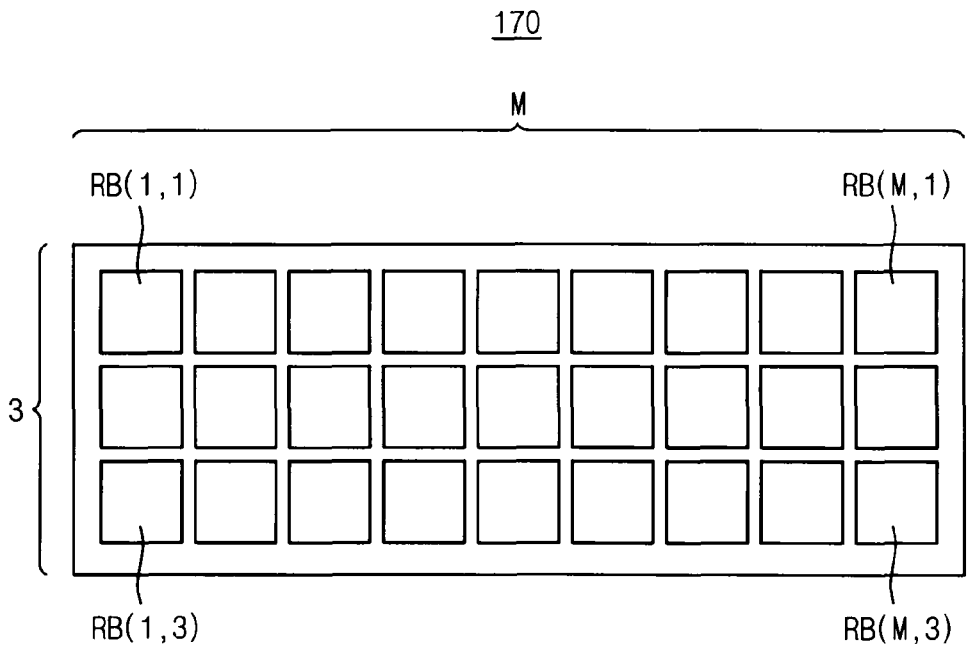
FIG. 5 illustrates an example of a pixel block memory included in the data compensating apparatus of FIG. 1.

FIG. 5 illustrates an example of a pixel block memory included in the data compensating apparatus of FIG. 1.

Referring to FIGS. 1A and 5, the data compensating apparatus 100 further include the pixel block memory 170.

As illustrated in FIG. 5, in some embodiments, the pixel memory block 170 includes Mx3 register blocks RB(1, 1) through RB(3, M). In this case, the calculated pixel block voltage drops from the voltage drop calculator 140 can be sequentially input to the pixel block memory 170, and the pixel block memory 170 can sequentially output the pixel block voltage drops depending on the input sequence.

Each of register blocks RB(1, 1) through RB(3, M) can temporarily store the pixel block voltage drops of pixel blocks, and output the stored pixel block voltage drops to the interpolator 150 for calculating the pixel voltage drop of the pixels (or for interpolating the voltage drops). In some embodiments, the number of the pixel blocks corresponds to an integer multiple of the number of register blocks RB(1, 1) through RB(3, M).

Figure 6:
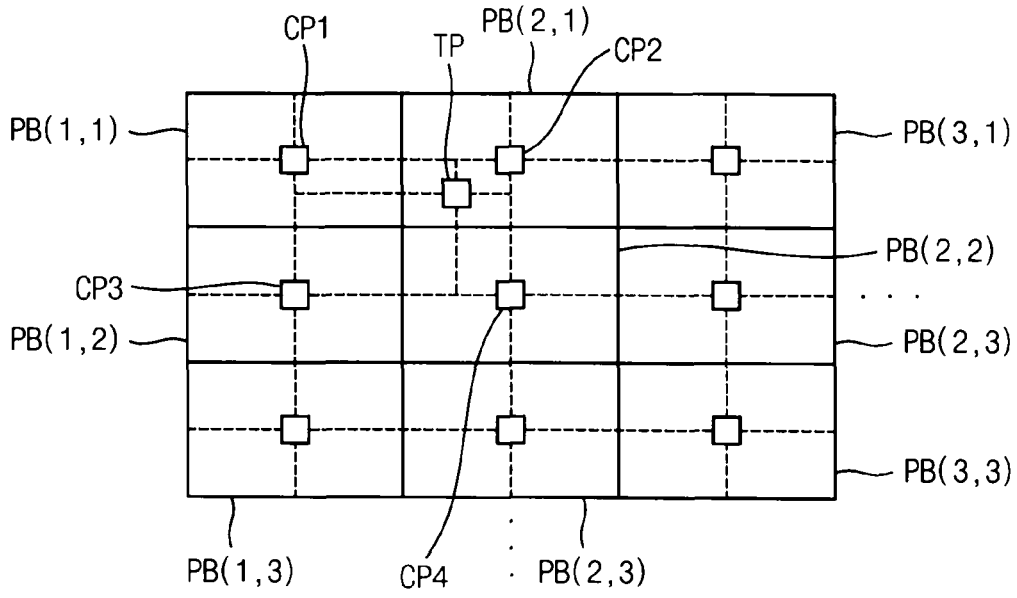
FIG. 6 illustrates an example of an operation of an interpolator included in the data compensating apparatus of FIG. 1.

FIG. 6 illustrates an example of an operation of an interpolator included in the data compensating apparatus of FIG. 1.

FIG. 6 shows an example of a portion 210 of the display panel to explain an operation of the interpolator 150. Referring to FIGS. 1A through 6, the interpolator 150 calculates a pixel voltage drop of a target pixel TP by bilinearly interpolating the pixel block voltage drops of adjacent ones of the target pixel blocks PB(1, 1), PB(2, 1), PB(1, 2), and PB(2, 2).

As illustrated in FIG. 6, the pixel blocks include center pixels CP1 through CP4 each located at a center of the each of the pixel blocks. For example, each of the center pixels through CP4 is located at a 60th pixel in the X-axis and Y-axis directions in each of the pixel blocks when each of the pixel blocks have 120×120 pixels.

The interpolator 150 can set the pixel voltage drop of each of the center pixels CP1 through CP4 to be the pixel block voltage drop of each of the target pixel blocks, and estimate the pixel voltage drop of the target pixel TP by performing a bilinear interpolation on the pixel voltage drops of adjacent four center pixels CP1 through CP4 that are adjacent to the target pixel TP. The pixel voltage drop of the target pixel TP can be set to be the interpolated value. The interpolator 150 can provide the pixel voltage drop of the target pixel TP to the compensated data generator 160.

Figure 7:
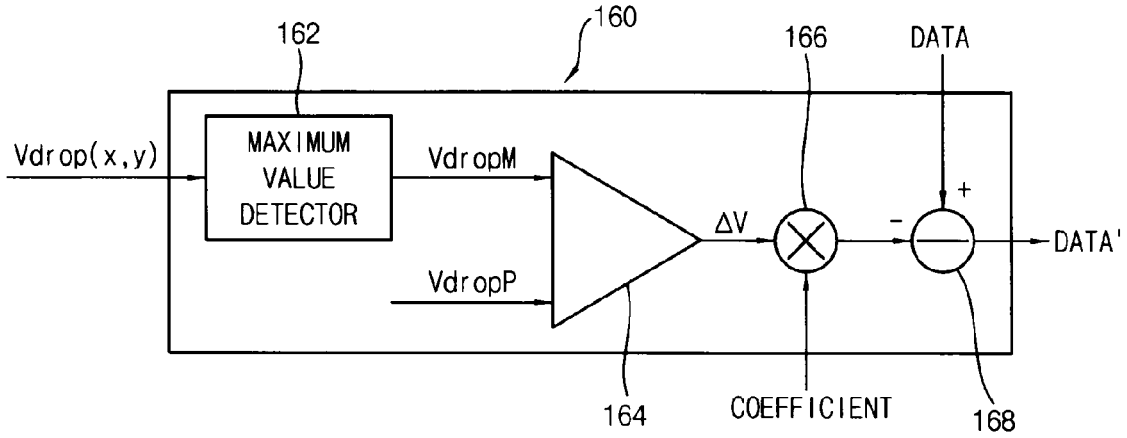
FIG. 7 illustrates an example of a compensating data generator included in the data compensating apparatus of FIG. 1.

FIG. 7 illustrates an example of a compensating data generator included in the data compensating apparatus of FIG. 1.

Referring to FIGS. 1A and 7, the compensated data generator 160 includes a maximum value calculator 162, a comparator 164, and a subtractor 168. The compensated data generator 160 can further include a multiplier 166 for multiplying a linear coefficient by an output value of the comparator 164.

In some embodiments, the compensated data generator 160 generates the compensated data voltage DATA' for compensating the data voltage DATA of the input image data based on a comparison result between the pixel block voltage drop Vdrop(x, y) of each of the pixel blocks and a maximum voltage drop VdropM.

The maximum value detector 162 can detect a maximum voltage drop VdropM among the pixel block voltage drops Vdrop(x, y) of the target pixel blocks in one frame. The maximum value detector 162 can receive the pixel block voltage drops Vdrop(x, y) of the target pixel blocks from the voltage drop calculator 140. The maximum value detector 160 can calculate the maximum voltage drop VdropM by comparing the pixel block voltage drops Vdrop(x, y) of the target pixel blocks.

In some embodiments, the maximum value detector 162 fixes the maximum voltage drop VdropM to be a predetermined value. For example, the maximum value detector 162 detects the maximum voltage drop VdropM when the display panel 200 emits full-white light, and the maximum value detector 162 fixes the detected value to be the maximum voltage drop VdropM. In this case, the compensated data generator 160 can generate the compensated data voltage DATA' based on the fixed maximum voltage drop VdropM. Thus, a maximum luminance of an image displayed on the display panel 200 can be maintained in a specific luminance level.

The comparator 164 can calculate a delta value ΔV that is a difference between the maximum voltage drop VdropM and the pixel voltage drop VdropP of the target pixel. The subtractor 168 can generate the compensated data voltage DATA' by subtracting the delta value ΔV from the data voltage DATA of the input image data. For example, the compensated data generator 160 converts the data voltage DATA to the compensated data voltage DATA' based on the delta value ΔV according to the maximum voltage drop VdropM.

In some embodiments, the compensated data generator 160 further includes the multiplier 166 for multiplying a linear coefficient by the output value (e.g., the delta value ΔV) of the comparator 164. The compensated data voltage DATA' can be adjusted based on the linear coefficient, so that the compensated data voltage DATA' can have dimming luminance information and/or a duty ratio for emitting light.

Figure 8:
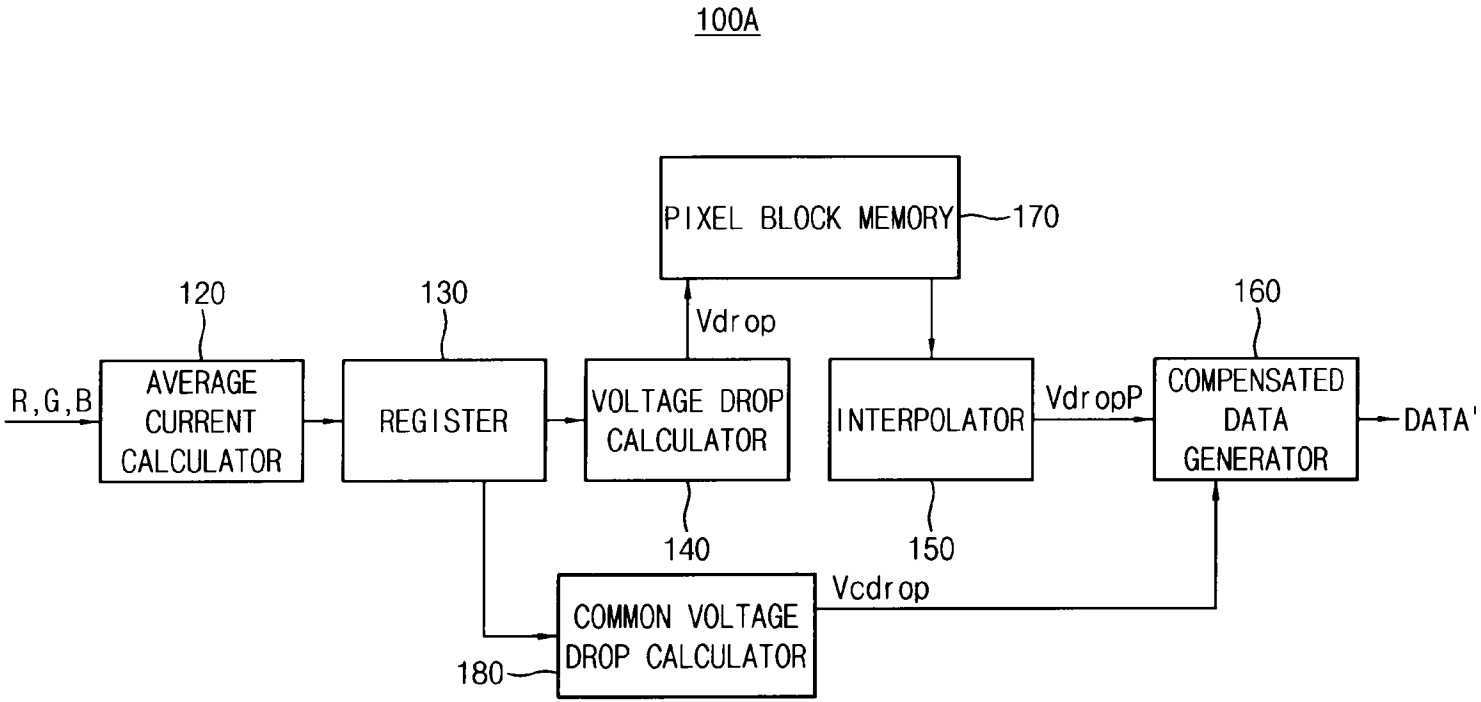
FIG. 8 is a block diagram of a data compensating apparatus according to example embodiments.

FIG. 8 is a block diagram of a data compensating apparatus according to example embodiments.

Referring to FIGS. 1A through 8, the data compensating apparatus 100A includes an average current calculator 120, a register 130, a voltage drop calculator 140, an interpolator 150, a compensated data generator 160, a pixel block memory 170, and a common voltage drop calculator 180.

In FIG. 8, like reference numerals are used to designate elements of the compensating data apparatus the same as those in FIG. 1A, and detailed description of these elements are omitted. The compensating data apparatus of FIG. 8 can be substantially the same as or similar to the compensating data apparatus of FIGS. 1A through 7 except for the common voltage drop calculator 180.

The average current calculator 120 can calculate an average current value of each of the pixel blocks PB based on input image data R, G, and B receiving from an external device.

The register 130 can store the average current values of each of the pixel blocks PB in the one frame.

The voltage drop calculator 140 can calculate pixel block voltage drops of power voltage each of target pixel blocks according to an X-axis voltage drop and a Y-axis voltage drop of the each of the target pixel blocks based on a product of an Y-axis voltage drop weighted value Yn and an X-axis voltage drop distribution coefficient.

The pixel block memory 170 can store the pixel block voltage drops Vdrop output from the voltage drop calculator 140. The pixel block memory 170 can include at least one register block corresponding to at least one pixel block PB.

The interpolator 150 can calculate a pixel voltage drop VdropP of a target pixel by interpolating the pixel block voltage drops Vdrop of adjacent ones of the target pixel blocks PB(x, y).

The compensated data generator 160 can generate a compensated data voltage DATA' by compensating the data voltage of the input image data R, G, and B based on the pixel voltage drop VdropP.

The common voltage drop calculator 180 can calculate a total current that is the sum of the average currents of the pixel blocks and calculate a common voltage drop Vcdrop of the display panel based on the total current. For example, the common voltage drop calculator 180 compares the total current with a current of output terminals of a power supply device to calculate the common voltage drop Vcdrop. The common voltage drop Vcdrop can correspond to a voltage drop across a power line between the display panel and the power supply device. The common voltage drop calculator 180 can provide data including the common voltage drop Vcdrop to the compensated data generator 160.

In some embodiments, the common data generator 160 generates the compensated data voltage DATA' based on respective values generated by adding the common voltage drop Vcdrop to the pixel block voltage drops of the target pixel blocks. Thus, the compensated data generator 160 can reflect the common voltage drop Vcdrop in the compensated data voltage DATA'.

In some embodiments, the common voltage drop generator 180 deactivates the compensated data generator 160 when the total current is less than a predetermined reference value. For example, the data compensating apparatus 100A does not generate the compensated data voltage DATA' when an amount of the voltage drop in the display panel is less than the predetermined reference value. Thus, a data driver in the display device can provide an original data voltage DATA based on the input image data R, G, and B to the display panel. As a result, power consumption for driving the data compensating apparatus 100A can be reduced.

Figure 9:
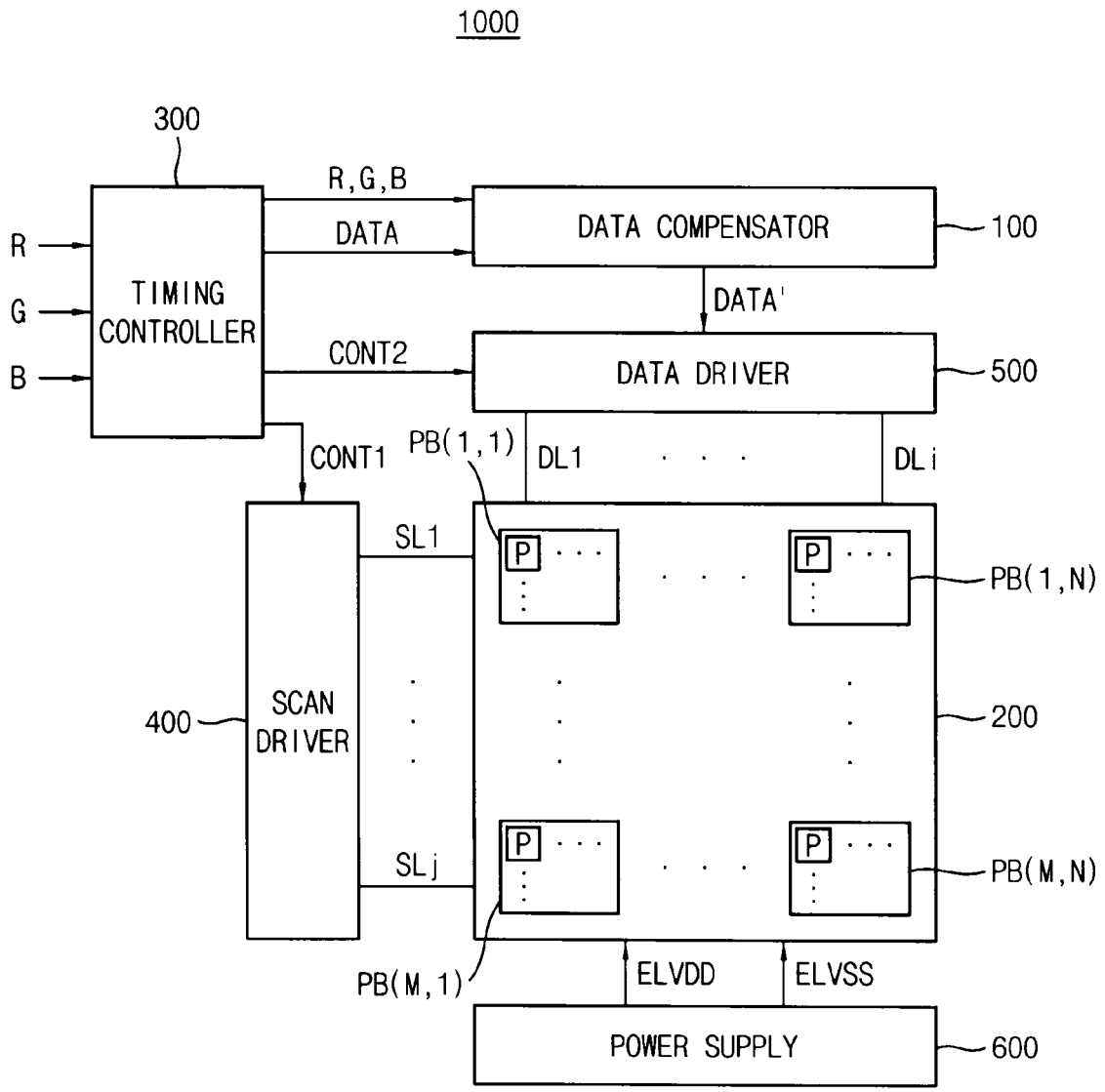
FIG. 9 is a block diagram of an OLED display according to example embodiments.

FIG. 9 is a block diagram of an OLED display according to example embodiments.

Referring to FIG. 9, the OLED display 1000 includes a data compensator 100, a display panel 200, a timing controller 300, a scan driver 400, a data driver 500, and a power supply 600.

The data compensator 100 can include an average current calculator, a voltage drop calculator, an interpolator, and a compensated data generator. The display panel 200 can include M×N pixel blocks PB(1, 1), . . . , PB(1, N), . . . , PB(M, 1), . . . , PB(M, N) each having a plurality of pixels P, where M and N are positive integers. The data compensator 100 can provide a compensated data voltage for compensating a data voltage DATA to the data driver 400. The data voltage DATA can be generated based on input image data R, G, and B.

The average current calculator can calculate an average current value of each of the pixel blocks based on the input image data R, G, and B received from an external device.

The voltage drop calculator can calculate pixel block voltage drops of each of target pixel blocks based on a product of a Y-axis voltage drop weighted value and an X-axis voltage drop distribution coefficient. The product of the Y-axis voltage drop weighted value and the X-axis voltage drop distribution coefficient can correspond to an amount of a current flowing into each of the target pixel blocks when a unit current is applied to a reference pixel block that is selected among the pixel blocks. The X-axis voltage drop distribution coefficient can be a normalized value of an X-axis voltage drop of one of the target pixel blocks located at a coordinate (x, y), where x is a positive integer less than or equal to M and y is a positive integer less than or equal to N, when the unit current is applied to the reference pixel block located at a coordinate (m, n), where m is a positive integer less than or equal to M and n is a positive integer less than or equal to N.

In some embodiments, the voltage drop calculator calculates the voltage drops of each of the target pixel blocks using Equation 3.

The interpolator can calculate a pixel voltage drop of a target pixel by interpolating the pixel block voltage drops of adjacent ones of the target pixel blocks.

The compensated data generator can generate a compensated data voltage DATA' by compensating the data voltage DATA of the input image data R, G, and B based on the pixel voltage drop.

In some embodiments, the data compensator 100 further includes a pixel block memory. The pixel block memory can temporarily store the pixel block voltage drops Vdrop output from the voltage drop calculator 140. In some embodiments, the data compensator 100 further includes a common voltage drop calculator. The common voltage drop calculator can calculate a total current that is a sum of the average currents of the pixel blocks and calculate a common voltage drop Vcdrop of the display panel based on the total current.

Since structures and operations of the data compensator 100 are described above referring to FIGS. 1A through 8, duplicated descriptions will not be repeated.

The display panel 200 can display an image. The display panel 200 can include a plurality of scan lines SL1 to SLj, a plurality of data lines DL1 to DLi, and a plurality of pixels P connected to the scan lines SL1 to SLj and the data lines DL1 to DLi. The display panel 200 can include M×N pixel blocks PB(1, 1), . . . , PB(1, N), . . . , PB(M, 1), . . . , PB(M, N) each having certain number of pixels. In some embodiments, each pixel block includes 120×120 pixels.

The timing controller 300 can control the scan driver 400 and the data driver 500. The timing controller 300 can receive an input control signal and input image data R, G, and B from an image source such as an external graphic apparatus. In some embodiments, the timing controller 300 generates a data voltage DATA which corresponds to operating conditions of the display panel 200 based on the input image data R, G, and B, and provides the data voltage DATA to the data compensator 100. In some embodiments, the timing controller 300 provides the data voltage DATA to the data driver 500. In addition, the timing controller 300 can generate a first control signal CONT1 for controlling a driving timing of the scan driver 400 and a second control signal CONT2 for controlling a driving timing of the data driver 500 based on the input control signal CONT. The timing controller 300 can respectively output the first and second control signals CONT1 and CONT2 to the scan driver 400 and the data driver 500.

The scan driver 400 can provide a plurality of scan signals to the display panel 200 respectively through the scan lines SL1 to SLj. The scan driver 400 can provide the scan signals to the scan lines SL1 to SLj based on the first control signal CONT1 received from the timing controller 300.

The data driver 500 can provide a plurality of compensated data voltages DATA' to the display panel 200 through the data lines DL1 to DLi. The data driver 500 can provide data signals including the compensated data voltages DATA' to the data lines DL1 to DLi based on the second control signal CONT2 received from the timing controller 300 and the compensated data voltages DATA' received from the data compensator 100. Thus, the display panel 200 can display the image based on the compensated data voltage DATA' for compensating a voltage drop of a first power voltage ELVDD.

The power supply 600 can provide the first power voltage ELVDD and a second power voltage ELVSS to the display panel 200 to drive the display panel 200.

As described above, the OLED display 1000 includes the data compensator to compensate the data voltage of the input image data R, G, and B in accordance with the X-axis voltage drop and the Y-axis voltage drop (i.e., the voltage drops in the X-axis and Y-axis directions) by using the simple hardware circuit and the predetermined X-axis voltage drop distribution coefficient Smn(x, y), so that the voltage drop of the pixel block PB and/or pixel can be calculated more accurately than typical techniques. Thus, unevenness of the luminance and image degradation with the voltage drop across power lines can be significantly improved.

The present embodiments can be applied to any display device and any system including the display device. For example, the present embodiments are applied to televisions, computer monitors, laptop computers, digital cameras, cellular phones, smartphones, smart pads, personal digital assistants (PDAs), portable multimedia players (PMPs), MP3 players, navigation systems, game consoles, video phones, etc.

The foregoing is illustrative of exemplary embodiments, and is not to be construed as limiting thereof. Although a few exemplary embodiments have been described, those skilled in the art will readily appreciate that many modifications are possible in these embodiments without materially departing from their novel teachings and advantages. Accordingly, all such modifications are intended to be included within the scope of the appended claims.

What is claimed is:

1. A data compensation circuit for compensating a voltage drop of a power voltage applied to a display panel of an organic light-emitting diode (OLED) display, the circuit comprising:

an average current calculator configured to calculate an average current value of each of M×N pixel blocks, where M and N are positive integers, based at least in part on input image data, wherein each of the M×N pixel blocks includes a plurality of pixels, and wherein a plurality of target pixel blocks are selected among the pixel blocks;

a voltage drop calculator configured to calculate one or more pixel block voltage drops of the power voltage of each of the selected target pixel blocks based at least in part on an X-axis voltage drop and a Y-axis voltage drop of each of the target pixel blocks, wherein voltage drop calculator is further configured to calculate the X-axis and Y-axis voltage drops based at least in part on the product of a Y-axis voltage drop weighted value and an X-axis voltage drop distribution coefficient;

an interpolator configured to interpolate the pixel block voltage drops of adjacent target pixel blocks so as to calculate a pixel voltage drop of a target pixel selected among one of the target pixel blocks; and a compensated data generator configured to compensate a data voltage of the input image data based at least in part on the pixel voltage drop so as generate a compensated data voltage.

2. The circuit of claim 1, wherein the product corresponds to an amount of current flowing into each of the target pixel blocks when a unit current is applied to a selected reference pixel block of the pixel blocks.

3. The circuit of claim 1, wherein the Y-axis voltage drop weighted value includes a weighted value of the Y-axis voltage drop of each of the target pixel blocks when a unit current is applied to a selected reference pixel block of the pixel blocks.

4. The circuit of claim 3, wherein the voltage drop calculator is further configured to set the Y-axis voltage drop weighted value to have a Y-coordinate value of the reference pixel block when the Y-coordinate value of the reference pixel block is less than a Y-coordinate value of each of the target pixel blocks, and wherein the voltage drop calculator is further configured to set the Y-axis voltage drop weighted value to have the Y-coordinate value of each of the target pixel blocks when the Y-coordinate value of the reference pixel block is greater than or equal to the Y-coordinate value of each of the target pixel blocks.

5. The circuit of claim 3, wherein the X-axis voltage drop distribution coefficient is represented as Smn(x, y), and wherein the Smn(x, y) is a normalized value of the X-axis voltage drop of each of the target pixel blocks located at a coordinate (x, y) when the unit current is applied to the reference pixel block located at a coordinate (m, n), where x and m are positive integers less than or equal to M, and where y and n are a positive integer less than or equal to N.

6. The circuit of claim 5, wherein a first X-axis voltage drop distribution coefficient is substantially equal to a second X-axis voltage drop distribution coefficient, wherein the first X-axis voltage drop distribution coefficient includes the X-axis voltage drop distribution coefficient of each of the target pixel blocks located at a second X-coordinate when the unit current is applied to the reference pixel block located at a first X-coordinate, and wherein the second X-axis voltage drop distribution coefficient includes the X-axis voltage drop distribution coefficient of each of the target pixel blocks located at the first X-coordinate when the unit current is applied to the reference pixel block located at the second X-coordinate.

7. The circuit of claim 5, wherein a first X-axis voltage drop distribution coefficient is substantially equal to a second X-axis voltage drop distribution coefficient, wherein the first X-axis voltage drop distribution coefficient is the X-axis voltage drop distribution coefficient of each of the target pixel blocks located at a second Y-coordinate when the unit current is applied to the reference pixel block located at a first Y-coordinate, and wherein the second X-axis voltage drop distribution coefficient is the X-axis voltage drop distribution coefficient of each of the target pixel blocks located at the first Y-coordinate when the unit current is applied to the reference pixel block located at the second Y-coordinate.

8. The circuit of claim 1, wherein the voltage drop calculator is further configured to calculate the pixel block voltage drop of each of the target pixel blocks based on the following Equation:

$$Vdrop(x, y) = Rs \times \sum_{m=1}^{M} \sum_{n=1}^{N} Imn \times Smn(x, y) \times Yn,$$

where Rs denotes a resistance coefficient, Imn denotes the average current value of a reference pixel block corresponding to a coordinate (m, n) selected among the pixel blocks, Smn(x, y) denotes the X-axis voltage drop distribution coefficient corresponding to a coordinate (x, y) selected among the target pixel blocks when a unit current flows through the reference pixel block, Yn denotes the Y-axis voltage drop weighted value, M denotes the total number of the pixel blocks in the X-axis direction, and N denotes the total number of the pixel blocks in the Y-axis direction.

9. The circuit of claim 8, wherein the voltage drop calculator includes:

a first multiplier configured to multiply the average current value of the reference pixel block corresponding to the coordinate (m, n) and the X-axis voltage drop distribution coefficient corresponding to the coordinate (x, y) so as to output a first result;

a second multiplier configured to multiply the first result corresponding to the coordinate (m, n) and the Y-axis voltage drop weighted value corresponding to the coordinate (m, n) so as to output a second result; and an adder configured to sum a plurality of second results for each coordinate (m, n) so as to output the pixel block voltage drop of each of the target pixel blocks.

10. The circuit of claim 1, wherein the pixel blocks include center pixels each located at a center of each of the pixel blocks, and wherein the interpolator is further configured to i) set the pixel voltage drop of each of the center pixels to be the pixel block voltage drop of each of the target pixel blocks, and ii) perform a bilinear interpolation operation on the pixel voltage drops of four center pixels that are adjacent to the target pixel so as to estimate the pixel voltage drop of a target pixel selected among one of the target pixel blocks.

11. The circuit of claim 10, wherein the compensated data generator includes:

a maximum value detector configured to detect a maximum voltage drop among the pixel block voltage drops of the target pixel blocks in one frame;

a comparator configured to calculate a delta value that is the difference between the maximum voltage drop and the pixel voltage drop of the target pixel; and a subtractor configured to subtract the delta value from the data voltage of the input image data so as to generate the compensated data voltage.

12. The circuit of claim 11, wherein the maximum value detector is configured to set the maximum voltage drop to be a predetermined value.

13. The circuit of claim 1, further comprising a common voltage drop calculator configured to i) calculate a total current value that is the sum of the average current values of the pixel blocks and ii) calculate a common voltage drop of the display panel based at least in part on the total current.

14. The circuit of claim 13, wherein the compensated data generator is configured to generate the compensated data voltage based at least in part on respective values, and wherein each of the respective values corresponds to the sum of the common voltage drop and the pixel block voltage drop of each of the target pixel block.

15. The circuit of claim 13, wherein the common voltage drop calculator is further configured to deactivate the compensated data generator when the total current is less than a predetermined reference value.

16. An organic light-emitting diode (OLED) display comprising:

a display panel including M×N pixel blocks each having a plurality of pixels, where M and N are positive integers, wherein a plurality of target pixel blocks are selected among the pixel blocks;

a data compensator configured to generate a compensated data voltage based at least in part on pixel block voltage drops of each of the pixel blocks, wherein the data compensator is further configured to calculate the pixel block voltage drops based at least in part on an X-axis voltage drop and a Y-axis voltage drop of each of the target pixel blocks, wherein the data compensator is further configured to calculate the X-axis and Y-axis voltage drops based at least in part on the product of an Y-axis voltage drop weighted value and a X-axis voltage drop distribution coefficient;

a scan driver configured to transmit a scan signal to the display panel;

a data driver configured to transmit the compensated data voltage to the display panel;

a timing controller configured to control the scan driver and the data driver; and a power supply configured to supply a first power voltage and a second power voltage to the display panel.

17. The display of claim 16, wherein the data compensator includes:

an average current calculator configured to calculate the average current value of each of the pixel blocks based at least in part on input image data;

a voltage drop calculator configured to calculate the pixel block voltage drops of the first power voltage of each of the target pixel blocks;

an interpolator configured to interpolate the pixel block voltage drops of adjacent target pixel blocks so as to calculate a pixel voltage drop of a selected target pixel of each of the target pixel blocks; and a compensated data generator configured compensate a data voltage of the input image data based at least in part on the pixel voltage drop so as to generate the compensated data voltage.

18. The display of claim 17, wherein the product of the Y-axis voltage drop weighted value and the X-axis voltage drop distribution coefficient corresponds to an amount of a current flowing into each of the target pixel blocks when a unit current is applied to a selected reference pixel block of the pixel blocks.

19. The display of claim 18, wherein the X-axis voltage drop distribution coefficient is a normalized value of the X-axis voltage drop of each of the target pixel blocks located at a coordinate (x, y), when the unit current is applied to the reference pixel block located at a coordinate (m, n), where x and m are positive integers less than or equal to M, and where y and n are positive integers less than or equal to N.

20. The display of claim 19, wherein the voltage drop calculator is further configured to calculate the pixel block voltage drop of each of the target pixel blocks based on the following Equation:

$$Vdrop(x, y) = Rs \times \sum_{m=1}^{M} \sum_{n=1}^{N} Imn \times Smn(x, y) \times Yn,$$

where Rs denotes a resistance coefficient, Imn denotes the average current value of the reference pixel block corresponding to the coordinate (m, n), Smn(x, y) denotes the X-axis voltage drop distribution coefficient corresponding to the coordinate (x, y) selected among the target pixel blocks when the unit current flows through the reference pixel block, Yn denotes the Y-axis voltage drop weight, M denotes the total number of the pixel blocks in the X-axis direction, and N denotes the total number of the pixel blocks in the Y-axis direction.

21. A data compensation circuit for compensating a voltage drop of a power voltage applied to a display panel of an organic light-emitting diode (OLED) display, the circuit comprising:

an average current calculator configured to calculate an average current value of each of M×N pixel blocks, where M and N are positive integers, based on input image data, wherein each of the M×N pixel blocks includes a plurality of pixels, and wherein a plurality of target pixel blocks are selected from among the pixel blocks; and a voltage drop calculator configured to calculate an X-axis voltage drop and a Y-axis voltage drop of each of the target pixel blocks based on the product of a Y-axis voltage drop weighted value and an X-axis voltage drop distribution coefficient, wherein the voltage drop calculator is further configured to calculate one or more pixel block voltage drops of the power voltage of each of the selected target pixel blocks based on the X-axis and Y-axis voltage drops.

22. The circuit of claim 21, wherein the product corresponds to the magnitude of current flowing into each of the target pixel blocks when a unit current is applied to a selected reference pixel block of the pixel blocks.

23. The circuit of claim 21, wherein the Y-axis voltage drop weighted value includes a weighted value of the Y-axis voltage drop of each of the target pixel blocks when a unit current is applied to a selected reference pixel block of the pixel blocks.

24. The circuit of claim 21, further comprising a common voltage drop calculator configured to i) calculate a total current value that is the sum of the average current values of the pixel blocks and ii) calculate a common voltage drop of the display panel based on the total current.

25. The circuit of claim 24, further comprising:

an interpolator configured to interpolate the pixel block voltage drops of adjacent target pixel blocks so as to calculate a pixel voltage drop of a target pixel selected among one of the target pixel blocks; and a compensated data generator configured to compensate a data voltage of the input image data based on the pixel voltage drop so as generate a compensated data voltage, wherein the compensated data generator is further configured to generate the compensated data voltage based on respective values, and wherein each of the respective values corresponds to the sum of the common voltage drop and the pixel block voltage drop of each of the target pixel block.

* * * * *